US007540598B2

(12) United States Patent
Hori et al.

(10) Patent No.: US 7,540,598 B2
(45) Date of Patent: Jun. 2, 2009

(54) LIQUID CONTAINER, SUB TANK, LIQUID DISCHARGE APPARATUS, LIQUID SUPPLY APPARATUS, AND IMAGING APPARATUS

(75) Inventors: Eisuke Hori, Tokyo (JP); Toshiroh Tokuno, Kanagawa (JP); Tetsuya Kaneko, Kanagawa (JP); Kenji Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 329 days.

(21) Appl. No.: 10/559,150

(22) PCT Filed: Jun. 21, 2004

(86) PCT No.: PCT/JP2004/009051

§ 371 (c)(1),
(2), (4) Date: Dec. 5, 2005

(87) PCT Pub. No.: WO2005/000684

PCT Pub. Date: Jan. 6, 2005

(65) Prior Publication Data

US 2007/0109362 A1 May 17, 2007

(30) Foreign Application Priority Data

| | | |
|---|---|---|
| Jun. 25, 2003 | (JP) | 2003-180911 |
| Aug. 8, 2003 | (JP) | 2003-289943 |
| Aug. 19, 2003 | (JP) | 2003-294861 |
| Aug. 19, 2003 | (JP) | 2003-294914 |

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 5,963,237 A * 10/1999 Ikkatai et al. ..... 347/85

(Continued)

FOREIGN PATENT DOCUMENTS

| | | |
|---|---|---|
| JP | 3-7350 | 1/1991 |
| JP | 5-270004 | 10/1993 |
| JP | 6-183023 | 7/1994 |

(Continued)

OTHER PUBLICATIONS

Nov. 15, 2007 official action in connection with corresponding Singaporean application No. 200507788-8.

(Continued)

*Primary Examiner*—Anh T. N. Vo
(74) *Attorney, Agent, or Firm*—Cooper & Dunham, LLP

(57) ABSTRACT

A sub tank is provided that includes a case at which an air flow path is formed, the air flow path including an entrance flow path portion that is connected to an ink accommodating portion of the case, and a cross flow path portion that continues from the entrance flow path portion. The cross flow path portion extends in an upper diagonal direction with respect to a reference plane corresponding to the ink liquid level at a standstill state. Another sub tank is provided that includes a case forming an ink accommodating portion, on which case a flexible film member is attached through bonding or welding to seal an opening of the ink accommodating portion and to form one side of the sub tank. A spring is disposed within the ink accommodating portion between the case and the flexible film member, the spring forcing the flexible film member outward.

16 Claims, 23 Drawing Sheets

U.S. PATENT DOCUMENTS

| | | | | |
|---|---|---|---|---|
| 6,270,207 | B1 * | 8/2001 | Sasaki | 347/86 |
| 6,520,630 | B1 * | 2/2003 | Oda et al. | 347/85 |
| 6,540,321 | B1 * | 4/2003 | Hirano et al. | 347/22 |
| 6,712,460 | B2 * | 3/2004 | Ohashi et al. | 347/86 |
| 6,773,099 | B2 * | 8/2004 | Inoue et al. | 347/86 |
| 2003/0052950 | A1 | 3/2003 | Ohashi et al. | |

FOREIGN PATENT DOCUMENTS

| | | |
|---|---|---|
| JP | 8-2651 | 1/1996 |
| JP | 8-156282 | 6/1996 |
| JP | 8-323989 | 12/1996 |
| JP | 9-94972 | 4/1997 |
| JP | 10-129007 | 5/1998 |
| JP | 11-240171 | 9/1999 |
| JP | 2000-225714 | 8/2000 |
| JP | 2000-273906 | 10/2000 |
| JP | 2001-71451 | 3/2001 |
| JP | 2001-301187 | 10/2001 |
| JP | 2002-86748 | 3/2002 |
| JP | 2002-234189 | 8/2002 |
| JP | 2002-273905 | 9/2002 |
| JP | 2002-292897 | 10/2002 |
| JP | 2002-316428 | 10/2002 |
| JP | 2003-1846 | 1/2003 |
| JP | 2003-53993 | 2/2003 |
| JP | 2003-191495 | 7/2003 |

OTHER PUBLICATIONS

Apr. 10, 2008 Japanese official action in connection with corresponding Japanese patent application No. 2003-180911.
Jul. 4, 2008 Japanese official action in connection with corresponding Japanese application No. 2003-289943.
Jul. 11, 2008 Japanese official action in connection with corresponding Japanese application No. 2003-294861.

* cited by examiner

LIQUID CONTAINER, SUB TANK, LIQUID DISCHARGE APPARATUS, LIQUID SUPPLY APPARATUS, AND IMAGING APPARATUS

TECHNICAL FIELD

This disclosure relates generally to a liquid container, a sub tank, a liquid discharge apparatus, a liquid supply apparatus, and an imaging apparatus.

BACKGROUND ART

In an inkjet recording apparatus that may be applied to an imaging apparatus such as a printer, a facsimile machine, a copier, and a plotter, for example, a small capacity sub tank is implemented on a carriage, a large capacity main cartridge (main tank) is implemented in a main body of the apparatus, and an apparatus for supplying ink from the main cartridge at the apparatus main body to the sub tank is provided.

In Japanese Patent Laid-Open Publication No. 2003-53993, a sub tank including a movable part that is made of a deformable film sheet, a spring that is adapted to supply negative pressure, and a supply/exhaust path that supplies ink and discharges mixed gas is provided. In this sub tank, the supply/exhaust path is positioned so that interference with the movable part and the spring may be avoided.

In Japanese Patent Laid-Open Publication No. 2002-86748, another exemplary sub tank is disclosed, this sub tank including an ink chamber that deforms according to ink volume while maintaining a negative pressure of the ink, an ink entering unit and exhaust unit that are implemented at an upper portion of the ink chamber, and an ink supply unit that is implemented at a lower portion of the ink chamber. The ink entering unit includes a valve seat made of an elastic material and having an ink entering path, a supply valve having a valve portion, and an elastic member that seals together the valve portion and the valve seat with pressure to block the ink entering path. The exhaust unit includes a seal portion made of elastic material and having a closed slit at its center.

In Japanese Patent Laid-Open Publication No. 2003-1846, a sub tank and a liquid supply apparatus including such a sub tank are disclosed, the sub tank including a negative pressure generation unit that expands and contracts by the supplying and discharging of a fluid therein, an atmospheric release unit that opens the sub tank to the atmosphere, and an ink supply unit for supplying ink. In this prior art example, upon supplying liquid from a main tank to the sub tank, the interior portion of the sub tank is exposed to the atmosphere by means of the atmospheric release unit, the fluid is supplied to the negative pressure generation unit so that it expands, and the liquid is thereby supplied to the sub tank. After the liquid is supplied to the sub tank, the atmospheric release unit is closed, and the negative pressure unit is contracted so that a negative pressure is generated within the sub tank.

In an imaging apparatus implementing a sub tank of the conventional art, a supply tube that supplies ink from the main tank to the sub tank, and a flexible film member that is used as a damper for controlling the pressure fluctuation within the sub tank are implemented. With long term use, air gradually penetrates through such components, and the air may accumulate in the sub tank. Also, a small amount of air may enter the main tank upon its detachment, and this air may also be supplied to the sub tank along with ink.

Accordingly, in the sub tank of Japanese Patent Laid-Open Publication No. 2003-53993, the ink supply path is also used as an air exhaust path so that the air in the sub tank may be discharged. However, in this case, when the imaging apparatus is not used for a long period of time, ink adhering to the entrance portion of the supply exhaust path may grow viscous and the path may be sealed by this ink.

Thus, it is preferred that the ink entering path and the exhaust unit for discharging air within the sub tank be separately implemented in the sub tank as in the case of Japanese Patent Laid-Open Publication No. 2002-86748. However, even in this prior art example, when ink enters the exhaust unit, the same effect as that described above may occur when the imaging apparatus is not used for a long period of time; that is, the ink at the entrance portion of the exhaust unit may grow viscous and may seal the exhaust path.

A sub tank is preferably arranged to have an ink accommodating portion for accommodating ink, and an air flow path for discharging air from the ink accommodating portion, in which sub tank the entrance portion of the air flow path is positioned above the liquid level of ink accommodated in the ink accommodating portion so that ink does not enter the air flow path.

However, when the imaging apparatus is in use, ink may enter the air flow path due to movement of the carriage which causes the liquid level of ink in the sub tank to fluctuate. As a result, ink may adhere to a sealing member of an air releasing valve that is used for opening and closing the air flow path, and the ink may grow viscous so that sealing may not be realized and the air flow path may be blocked.

Also, in a case where a deformable film sheet is used to seal a path in the sub tank as in the case of Japanese Patent Laid-Open Publication No. 2003-53993, the air flow path may be formed into a trench that is sealed by the film sheet. In such configuration, the ink may be pulled into the air flow path due to the capillary effect.

Additionally, in the sub tank disclosed in Japanese Patent Laid-Open Publication No. 2003-1846, since the negative pressure generation unit that expands and contracts by the supplying and discharging of fluid is implemented in the sub tank, a mechanism for supplying the fluid for expanding and contracting the negative pressure generation unit is needed aside from the mechanism for supplying the liquid to the sub tank in order for the negative pressure to be generated within the sub tank. Thereby, the structure of the sub tank may be quite complicated.

Similarly, in the sub tank of Japanese Patent Laid-Open Publication No. 2002-86748, since a flexible container that accommodates ink is implemented inside the case, and the flexible container is expanded and contracted by suction/atmospheric release of the case, the structure of the negative pressure generation unit may be complicated.

Also, in an inkjet recording apparatus, ink may adhere in the recording head nozzles due to the increase in the ink viscosity and the drying of ink. Accordingly, in Japanese Patent Laid-Open Publication No. 2002-234189, and in Japanese Patent Publication No. 8-2651, disclosures are made pertaining to a restoration operation for restoring the states of recording head nozzles by capping the nozzles with a cap at predetermined timings and absorbing ink from the nozzles.

Also, in Japanese Patent Laid-Open Publications No. 5-270004, No. 8-156282, and No. 2001-71451, disclosures are made of inkjet recording apparatuses that have ink supplied thereto directly from an ink cartridge (main tank) without using a sub tank, in which an ink end (out of ink condition), including a near end, for ink in a cartridge can be detected, and when one of plural inks in different colors is detected to have reached its end, the printing mode is switched from full color printing to monocolor printing.

In a case where a restoration operation is performed in a liquid discharge apparatus including a conventional sub tank as described above, bubbles are likely to be generated when air is present in the sub tank so that the nozzles may easily come off. Also, it is noted that control of the negative pressure may be difficult, and ink discharge characteristics may be susceptible to fluctuations.

In an imaging apparatus using a liquid storage tank (main tank) and a sub tank, as the ink in the sub tank is consumed through ink discharge by the ink discharge heads, and through the restoration operation, the sub tank has to be appropriately replenished with ink from the main tank. Further, when the sub tank implements a flexible film member and an elastic member to generate a negative pressure as is described above, the capacity of the sub tank changes, and thereby, the amount of ink remaining in the sub tank may not be accurately detected.

Also, according to tests conducted by the inventors of the present invention, it has been determined that when the capacity of the sub tank is significantly reduced, a hysteresis in the capacity change occurs at the time the elastic member for generating a negative pressure is contracted and at the time the elastic member returns to its initial state. When such hysteresis occurs, instability is created in the control of the negative pressure, and the liquid discharge characteristics become unstable. In turn, deviations in the ink ejection and differences in the ink discharge speed may occur.

SUMMARY

In an aspect of this disclosure, a liquid container that can reduce the inflow of liquid into an air flow path configured for discharging air from a liquid accommodating member, a liquid supply apparatus including such a liquid container, and an imaging apparatus including such a liquid supply apparatus are provided.

In another aspect of this disclosure, a sub tank that is capable of generating a negative pressure using a simple structure, a liquid supply apparatus that includes such a sub tank, and an imaging apparatus that includes such a sub tank or liquid supply apparatus are included.

In another aspect, an imaging apparatus is provided that is capable of supplying liquid to a sub tank according to a liquid consumption amount.

In another aspect, means is provided to enable negative pressure control of the sub tank when a nozzle restoration operation is being conducted so as to stabilize liquid discharge characteristics.

In another aspect of this disclosure, a liquid container that accommodates liquid used in an imaging apparatus is provided, the liquid container including a liquid accommodating portion for accommodating the liquid and an air flow path for discharging air from the liquid accommodating portion, the air flow path including an entrance flow path portion that is connected to the liquid accommodating portion, and a continued flow path portion that continues from the entrance flow path portion, the continued flow path portion being arranged to extend in an upper diagonal direction with respect to a reference plane corresponding to a liquid level of the liquid accommodated in the liquid accommodating portion at a standstill state. Herein, the liquid may be prevented from penetrating into the atmospheric release side of the air flow path when fluctuation of the liquid level occurs.

In another aspect of the present invention, a liquid container that accommodates liquid used in an imaging apparatus is provided, the liquid container including a container main body that forms a liquid accommodating portion for accommodating the liquid; a flexible film member that is attached to the container main body and is adapted to seal an opening of the liquid accommodating portion; and an air flow path that is formed at the container main body and is adapted to discharge air from the liquid accommodating portion; wherein the air flow path includes a flow path portion that does not have a wall formed by the flexible film member. Herein, the liquid may be prevented from penetrating into the atmospheric release side of the air flow path.

In another aspect of the present invention, a liquid supply apparatus that includes a liquid container of the present invention is provided so that reliability may be improved in supplying the liquid to a recording head.

In another aspect of the present invention, an imaging apparatus that includes a liquid supply apparatus of the present invention is provided so that reliability may be improved in supplying the liquid to a recording head, and stable image formation may be realized.

In another aspect of the present invention, a sub tank containing liquid supplied from a main tank and being adapted to supply the liquid to a liquid discharge head that discharges the liquid is provided, the sub tank including:

a negative pressure generation unit that includes a flexible film member that is disposed on at least one side of the sub tank, and an elastic member that forces the flexible film member outward with respect to the sub tank, the negative pressure generation unit being adapted to expand and contract in response to the supply and discharge of the liquid and generate a negative pressure within the sub tank.

According to preferred embodiments of the present invention, the flexible film member may have a thickness within a range of 10~100 μm. Also, the flexible film member may include at least two types of films that are laminated, and the flexible film member may include at least a polyethylene film and a nylon film. Additionally, the flexible film member may include a silica vapor deposition layer.

According to other preferred embodiments of the present invention, the flexible film member may have a protruding portion, and the flexible film member may be formed by molding a film sheet into a convex shape.

According to another preferred embodiment of the present invention, the elastic member may correspond to a spring.

According to another preferred embodiment, the sub tank of the present invention may further include a case that includes a negative pressure lever that is arranged to be in contact with an outer side of the flexible film member, the negative pressure lever being displaced in response to a deformation of the flexible film member.

According to another preferred embodiment, the sub tank of the present invention may further include an atmospheric release unit for opening the sub tank to the atmosphere.

In another aspect of the present invention, a liquid supply apparatus is provided, the liquid supply apparatus including a sub tank of the present invention including an atmospheric release unit, wherein liquid is supplied from a main tank to the sub tank by opening the sub tank to the atmosphere by the atmospheric release unit, and expanding the negative pressure generation unit, after which a negative pressure is generated within the sub tank by closing the atmospheric release unit, discharging a portion of the liquid in the sub tank, and causing the negative pressure generation unit to contract.

In another aspect of the present invention, an imaging apparatus is provided, the image apparatus including a sub tank or a liquid supply apparatus of the present invention to supply liquid to a liquid discharge head that discharges liquid onto a recording medium.

In another aspect of the present invention, a negative pressure may be generated within a sub tank by using a flexible film member and an elastic member and by supplying liquid into the sub tank, to thereby simplify the negative pressure generation mechanism. Accordingly, structures of the sub tank, a liquid supply apparatus, and an imaging apparatus of the present invention may be simplified.

In another aspect of the present invention, an imaging apparatus is provided that detects an amount of liquid that is consumed from the sub tank and performs a liquid supply operation of supplying liquid to the sub tank according to the detected liquid consumption amount.

According to a preferred embodiment of the present invention, information pertaining to a liquid discharge amount and an absorption amount is stored beforehand, and the amount of liquid consumed from the sub tank is obtained through calculation of formula (1) that is defined as $$\text{liquid consumption amount}=\Sigma(\text{liquid discharge amount}\times\text{number of discharges})+\Sigma(\text{absorption amount}\times\text{number of absorptions}) \quad (1).$$

In another preferred embodiment of the present invention, the calculated total sum of the liquid discharge amount is corrected using a predetermined correction coefficient that is set according to a parameter that reflects a discharge characteristic of the liquid discharge head.

According to another preferred embodiment of the present invention, information pertaining to a liquid discharge amount for a specific discharge pattern and an absorption amount is stored beforehand, and the amount of ink consumed from the sub tank is obtained through calculation of formula (2) that is defined as $$\text{liquid consumption amount}=\Sigma(\text{specific pattern discharge amount}\times\text{number of specific pattern discharges})+\Sigma(\text{absorption amount}\times\text{number of absorptions}) \quad (2).$$

According to another preferred embodiment of the present invention, the detected liquid consumption amount is compared with a first standard value V1, a second standard value V2, and a third standard value V3 (V1<V2<V3); and when the liquid consumption amount is greater than or equal to the first standard value V1, liquid is supplied to the sub tank right before capping the liquid discharge head;

when the liquid consumption amount is greater than or equal to the second standard value V2, liquid is supplied to the sub tank in between page output operations; and when the liquid consumption amount is greater than or equal to the third standard value, the sub tank is opened to the atmosphere at least once, after which liquid is supplied to the sub tank and a negative pressure is generated therein.

According to another preferred embodiment of the present invention, the detected liquid consumption amount is compared with a fourth standard value V4, a fifth standard value V5, and a sixth standard value V6 (V4<V5<V6 ), and when the liquid consumption amount is greater than or equal to the fourth standard value V4, printing with color ink is disabled after a page output operation;

when the liquid consumption amount is greater than or equal to the fifth standard value V5, printing with black ink is disabled after a page out operation; and when the liquid consumption amount is greater than or equal to the sixth standard value V6, printing with inks of all colors is disabled during a page output operation.

According to another preferred embodiment of the present invention, the viscosity of the liquid at 20° C. is greater than or equal to 4 mPa/sec. Also, in another preferred embodiment of the present invention, the liquid discharge head corresponds to a head that is adapted to discharge liquid based on a change in a piezoelectric element.

In another aspect of the present invention, a liquid discharge apparatus is provided that performs a nozzle restoration operation in which the sub tank is opened by an open-close unit in at least one of a case in which an amount of air within the sub tank is greater than or equal to a first predetermined amount and a case in which an amount of liquid within the sub tank is less than a second predetermined amount, and the sub tank is not opened in at least one of a case in which the amount of air within the sub tank is less than the first predetermined amount and a case in which the amount of liquid within the sub tank is greater than or equal to the second predetermined amount.

It is noted that the first predetermined amount for the amount of air and the second predetermined amount for the amount of liquid in the sub tank may have either different values, or the same value.

According to a preferred embodiment of the present invention, when the sub tank is not opened during the nozzle restoration operation, the nozzle is covered by a cap and liquid at a first absorption amount is absorbed from the nozzle, via the cap, and the sub tank is filled with liquid to a prescribed amount; and when the sub tank is opened during the nozzle restoration operation, the nozzle is covered by the cap and liquid at a second absorption amount is absorbed from the nozzle via the cap, and the sub tank is filled with liquid to the prescribed amount.

According to another preferred embodiment of the present invention, information pertaining to a liquid discharge amount and an absorption amount is stored beforehand, and an amount of liquid within the sub tank is obtained using formula (3) that is defined as $$\text{liquid amount in sub tank}=\text{full capacity of sub tank}-\{\Sigma(\text{discharge amount}\times\text{number of discharges})+\Sigma(\text{absorption amount}\times\text{number of absorptions})\} \quad (3).$$

According to another embodiment of the present invention, information pertaining to a liquid discharge amount for a specific discharge pattern and an absorption amount is stored beforehand, and an amount of liquid within the sub tank is obtained using formula (4) that is defined as $$\text{liquid amount in sub tank}=\text{full capacity of sub tank}-\{\Sigma(\text{specific pattern discharge amount}\times\text{number of specific pattern discharges})+\Sigma(\text{absorption amount}\times\text{number of absorptions})\} \quad (4).$$

According to another preferred embodiment of the present invention, the viscosity of the liquid at 20° C. is greater than or equal to 4 mPa/sec. Also, according to another preferred embodiment, the liquid discharge head corresponds to a head that is adapted to discharge liquid based on a change in a piezoelectric element.

In another aspect of the present invention, an imaging apparatus including the liquid discharge apparatus of the present invention is provided.

BEST MODE FOR CARRYING OUT THE INVENTION

In the following, preferred embodiments of the present invention are described with reference to the accompanying drawings.

Figure 1:
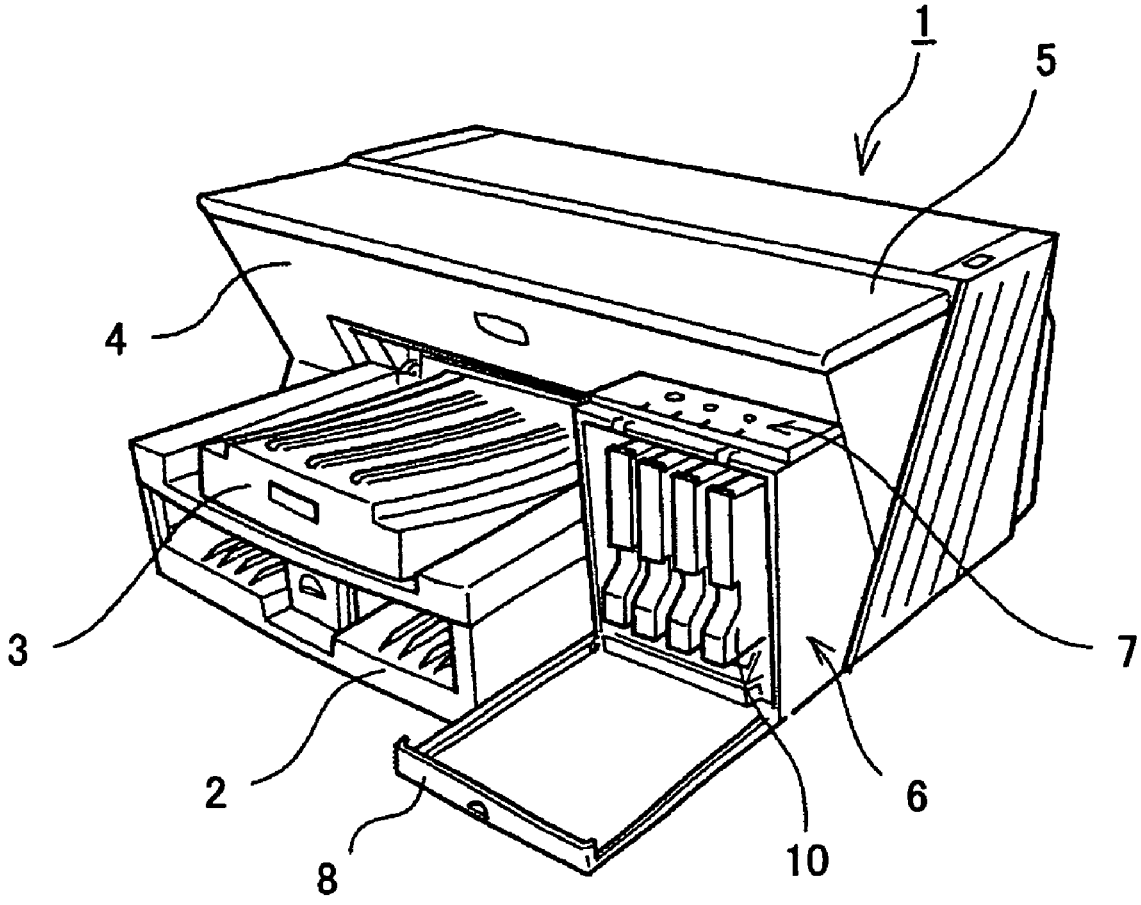
FIG. 1 is a perspective view of an inkjet recording apparatus according to an embodiment of the present invention.

FIG. 1 shows a perspective view of an inkjet recording apparatus according to an embodiment of the present invention that is viewed from the front side. The ink jet recording apparatus of FIG. 1 implements a liquid container and a liquid supply apparatus that correspond to embodiments of the present invention.

As is shown in this drawing, the inkjet recording apparatus includes an apparatus main body 1, a paper feed tray 2 that is attached to the apparatus main body 1, and a paper delivery tray 3 that is also attached to the apparatus main body 1. The paper feed tray 2 supplies paper to the apparatus, and the paper delivery tray 3 stacks paper having an image recorded (formed) thereon. Also, at one side of a front portion 4 of the apparatus, a cartridge load unit 6 that protrudes from the front portion 4 and is positioned lower than a top portion 5 of the apparatus is provided. The cartridge load unit 6 includes an operation unit 7 such as an operation key unit or a display unit on its upper side, and a cover 8 that may be opened and closed to remove an ink cartridge 10 corresponding to a liquid storage tank (main tank) for supplying liquid.

In the following, a configuration of the inkjet recording apparatus of FIG. 1 is described with reference to FIGS. 2 and 3.

Figure 2:
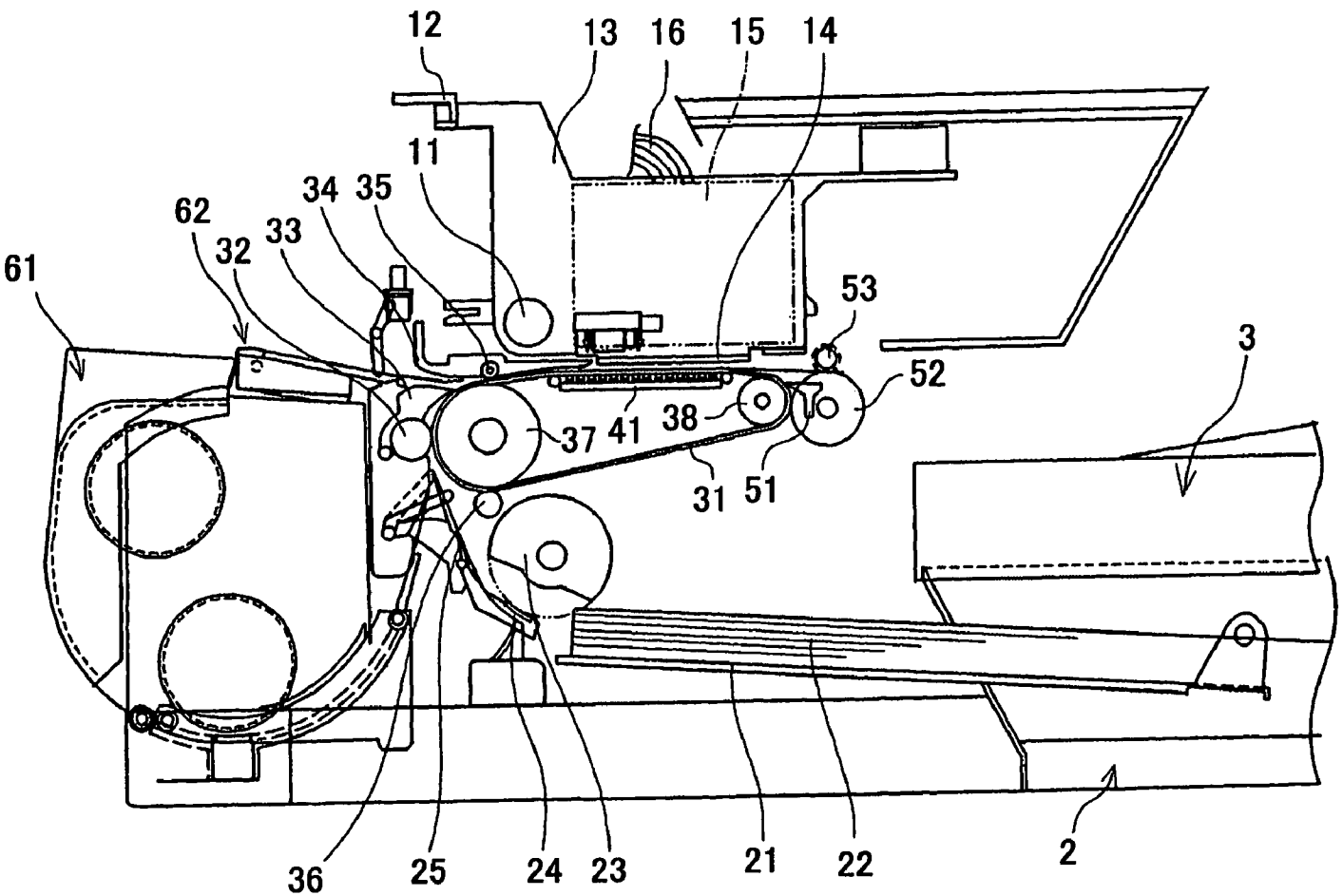
FIG. 2 is a cross-sectional diagram showing a configuration of the recording apparatus of FIG. 1.

FIG. 2 is a schematic diagram showing an overall configuration of the inkjet recording apparatus of FIG. 1. FIG. 3 is a plan view of the inkjet recording apparatus of FIG. 1.

The apparatus main body 1 includes a carriage 13 that is held by a guide rod 11 corresponding to a guide member that is supported by left and right side walls (not shown), and a stay 12 so that the carriage 13 may slide freely along a main scanning direction. The carriage 13 may be driven by a main scanning motor (not shown) to realize scanning in the directions indicated by the arrows in FIG. 3.

The carriage 13 includes four recording heads 14 corresponding to ink jet heads that discharge ink in colors yellow (Y), cyan (C), magenta (M), and black (Bk), respectively. The ink discharge openings of the recording heads 14 are arranged in a manner such that the ink discharge direction intersects the main scanning direction.

The inkjet heads used as the recording heads 14 include energy generating means for discharging ink. The energy generating means may correspond to a piezoelectric actuator (piezoelectric element), a thermal actuator implementing an electrothermal conversion element such as a thermal resistor and using liquid phase change that is caused by film boiling, a shape memory alloy actuator using metal phase change that is caused by temperature change, or an electrostatic actuator using electrostatic power, for example. In the present embodiment, a head that implements the piezoelectric actuator (piezoelectric element) as the energy generating means is used. Also, as the recording head 14, one ink jet head implementing plural nozzles arranged in an array for discharging ink in the respective colors may be used.

The carriage 13 also includes a sub tank 15 (liquid container) for each color for supplying ink to the recording head 14. Ink may be supplied to the sub tank 15 from the main tank (ink cartridge) 10 via an ink supply tube 16. Herein, each main tank 10 may accommodate ink in one of the colors yellow (Y), cyan (C), magenta (M), and black (Bk). In such case, the main tank 10 accommodating the black ink may be arranged to have a larger capacity compared to the main tanks 10 accommodating the other color inks.

The paper feed tray 2 includes a sheet stack unit (platen) 21 on which sheets 22 may be stacked, and a paper feed unit including a paper feed member 23, a separation pad 24 positioned opposite to the paper feed member 23, and a guide 25. The paper feed member 23 is for feeding the sheets 22 from the sheet stack 21 one by one, and the separation pad 24 is made of material with a high friction coefficient and is forced toward the paper feed guide 23 side. The guide 25 carries the sheet 22 to a carrier unit.

The carrier unit is for carrying the sheet 22 supplied by the paper feed unit to the recording head 14. The carrier unit includes a carrier belt 31, a counter roller 32, a carrier guide 33, a press member 34, a pressure applying drum 35, and a charge roller 36. The sheet 22 sent from the paper feed unit is adhered to the carrier belt 31 by electrostatic force, and the sheet is held in between the carrier belt 31 and the counter roller 32 to be carried further into the carrier unit. The carrier guide 33 changes the direction of the sheet 22 that is heading upward by approximately 90 degrees so that the sheet 22 may be carried along the carrier belt 31, and the pressure applying drum 35 is forced toward the carrier belt 31 by the press member 34 member, and the charge roller 36 charges the surface of the carrier belt 31.

The carrier belt 31 is a round belt with no end that is held between a carrier roller 37 and a tension roller 38. The carrier belt 31 is rotated along a belt carrying direction (sub scanning direction) as is indicated in FIG. 3. The charge roller 36 is arranged to be in contact with the surface of the carrier belt 31 to rotate according to the rotation of the carrier belt 31. The charge roller 36 applies a force of 2.5 N to each side of an axle.

At the inner side of the carrier belt 31, a guide member 41 is positioned at a region corresponding to a printing region of the recording head 14. The upper portion of the guide member 41 protrudes outward toward the recording head 14 with respect to the tangent line of the two rollers (i.e., carrier roller 37 and tension roller 38) supporting the carrier belt 31. In this way, the carrier belt 31 at the printing region may be pushed upward by the upper portion of guide member 41 and guided thereby, so that planarity may be accurately maintained.

On the surface of the guide member 41 that is in contact with the inner surface of the carrier belt 31, plural trenches extending in a direction perpendicular to the carrying direction are formed so that the area of contact between the guide member 41 and the carrier belt 31 may be reduced and the carrier belt 31 may move smoothly along the surface of the guide member 41. In this way, an image is recorded on the sheet 22 by the recording head 14, and the sheet 22 may be carried to a paper delivery unit.

The paper delivery unit for discharging the sheet 22 includes a separator member 51, a paper delivery roller 52, and a paper delivery drum 53. The paper delivery tray 3 is positioned below the paper delivery roller 52 to receive the sheet 22 discharged from the paper delivery unit. It is noted that a fair distance in height is provided from the point of contact between the paper delivery roller 52 and the paper delivery drum 53 to the position of the paper delivery tray 3 to increase the number of sheets that may be stacked onto the paper delivery tray 3.

Also, a dual side printing paper feed unit 61 may be detachably implemented to the rear side of the apparatus main body 1. The sheet 22 having an image printed on one side may be introduced into the dual side printing paper feed unit 61 through a reverse rotation of the carrier belt 31 so that the sheet 22 may be flipped and re-fed into the carrier unit via the counter roller 32 and the carrier belt 31. It is noted that a manual paper feed part 62 may be implemented on the upper side of the dual side printing paper feed unit 61.

Figure 3:
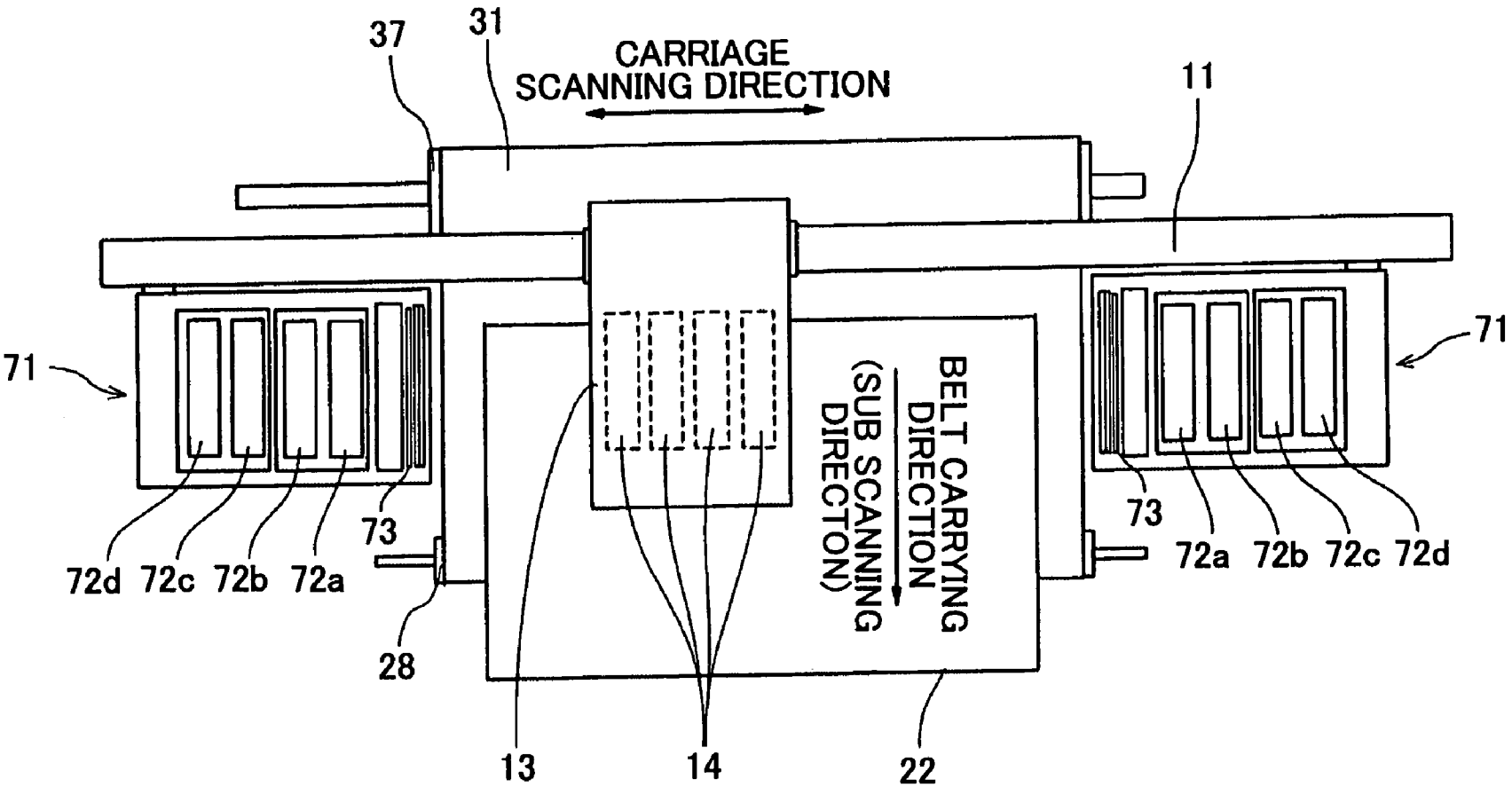
FIG. 3 is a top view of a portion of the recording apparatus of FIG. 1.

As is shown in FIG. 3, in the non-printing regions at the two sides of the carriage 13, maintenance/restoration systems 71 (referred to as 'subsystem' hereinafter) are implemented in order to maintain and restore the states of nozzles of the recording heads 14. The subsystems 71 may each include cap members 72*a*, 72*b*, 72*c*, and 72*d* for capping the nozzles of the recording heads 14, and a wiper blade 73 for wiping the nozzle surfaces, for example.

The cap member 72*a* that is closest to the printing region may be connected to a tube pump (not shown) corresponding to absorption means. The other cap members 72*b*, 72*c*, and 72*d* may not be connected to tube pumps. In this case, the cap member 72*a* corresponds to a restoration and moisture retention cap, and the other cap members correspond to simple moisture retention caps. Accordingly, when a restoration operation of the recording heads 14 is performed, the recording head 14 that is subjected to the restoration operation is selectively moved to a position at which the recording head 14 may be capped by the cap member 72*a*.

In the inkjet recording apparatus having the above-described configuration, a sheet 22 in the paper feed tray 2 is separated from other sheets 22 and fed into the apparatus main body 1. The sheet 22, which moves upward upon being fed, is guided by the guide 25 to be held between the carrier belt 31 and the counter roller 32 and carried. The sheet 22 is then guided by the carrier guide 33, and pressed to the carrier belt 31 by the pressure applying drum 35 so that the carrying direction of the sheet 22 is changed by approximately 90 degrees.

In such case, a control circuit (not shown) may control a high voltage power source to alternate between applying a positive output and a negative output to the charge roller 36; that is, switching voltages are applied to the charge roller 36. In this way, the carrier belt 31 may be charged according to the switching charge voltage pattern. More specifically, the carrier belt 31 may have positive and negative voltage charged strips with predetermined widths alternatingly arranged with respect to the rotating direction of the carrier belt 31, namely, the sub scanning direction. When the sheet 22 is supplied and placed on the carrier belt 31 that is alternatingly charged with positive and negative voltages, the sheet 22 may be adhered to the carrier belt 31. In this way, the sheet 22 is carried in the sub scanning direction by the rotation of the carrier belt 31.

By driving the recording heads 14 according to image signals, while moving the carriage 13 in the main scanning direction, ink may be discharged to record one image line on the sheet 22 in a still standing state, after which the sheet 22 is carried forward (sub scanning direction) by a predetermined distance to record the next image line. Upon receiving a recording termination signal or a signal indicating that the bottom end of the sheet 22 has reached the recording region, the recording operation is ended, and the sheet 22 is delivered to the paper delivery tray 3.

During printing (recording) standby time, the carriage 13 is moved toward one of the sub systems 71, and the recording heads 14 are capped by the cap members 72*a*~72*d* to retain the dampness of the nozzles of the recording heads 14 and prevent ink discharge problems due to the drying of ink. Also, a restoration operation that is irrelevant to the recording may be conducted before recording or during recording, for example, in order to maintain stability in the ink discharge performance of the recording heads 14. It is noted that in conducting the restoration operation in the present example, since the cap member 72*a* corresponds to a cap with restoration functions (e.g., suction functions), the recording head 14 subjected to the restoration operation is moved to the position of this cap member 72*a* to be capped by the cap member 72*a*.

In the following, referring to FIGS. 4 through 10, detailed descriptions are given of a sub tank according to an embodiment of the present invention, and ink supply apparatuses (liquid supply apparatuses) in which such sub tank may be implemented.

Figure 4:
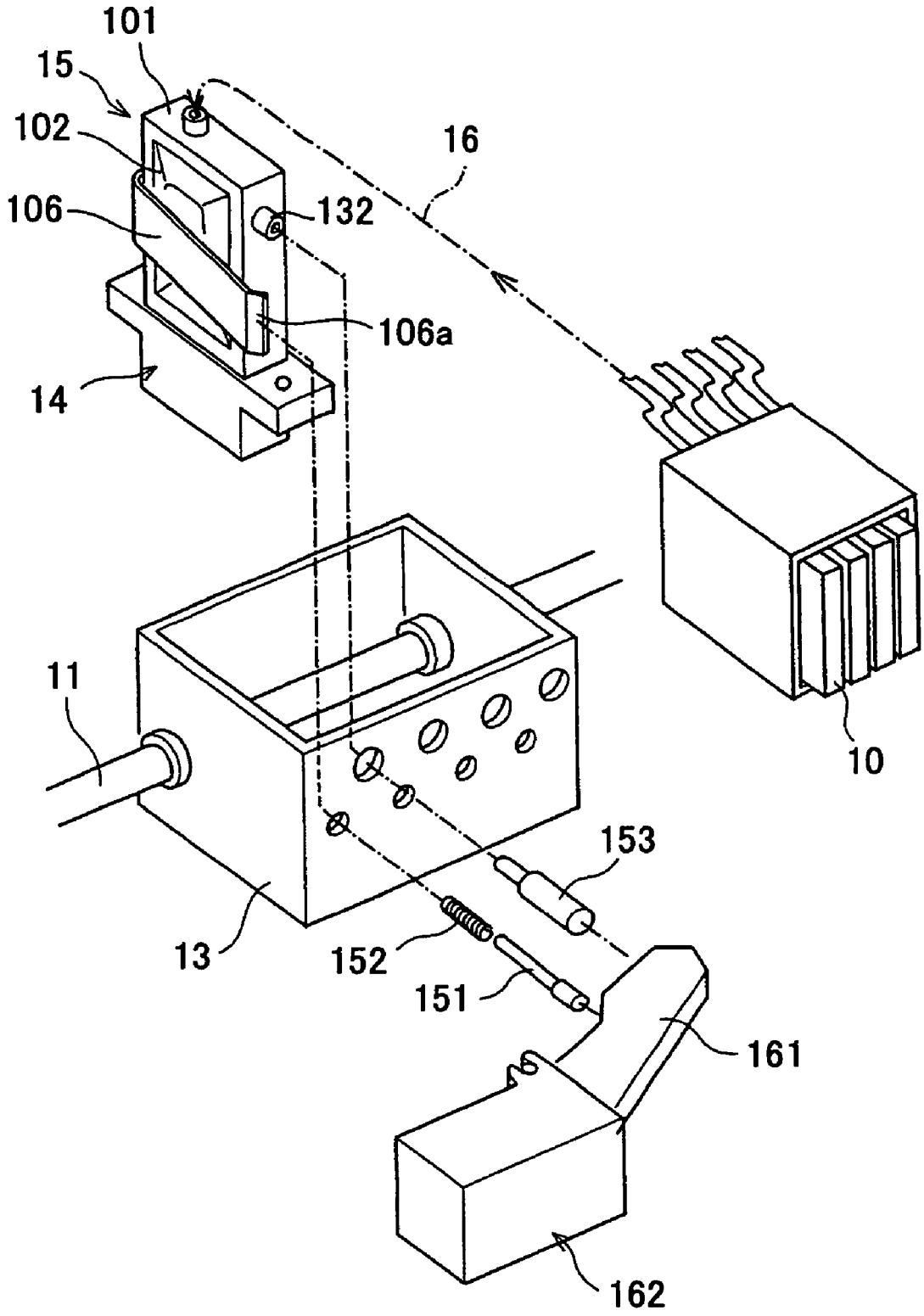
FIG. 4 is a perspective view of pertinent components of an ink supply apparatus according to an embodiment of the present invention.
Figure 5:
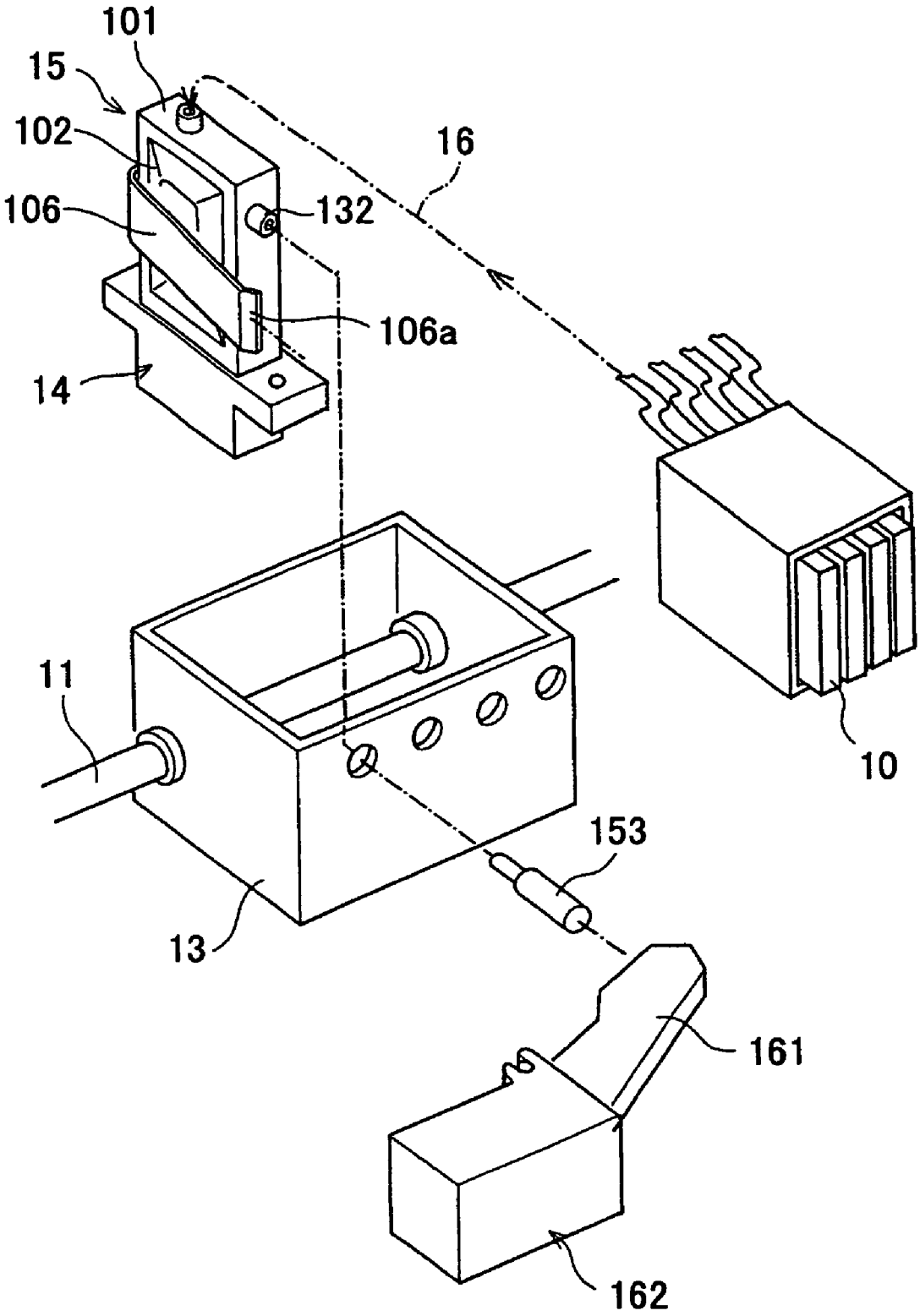
FIG. 5 is a perspective view of pertinent components of an ink supply apparatus according to a variation embodiment of FIG. 4.
Figure 6:
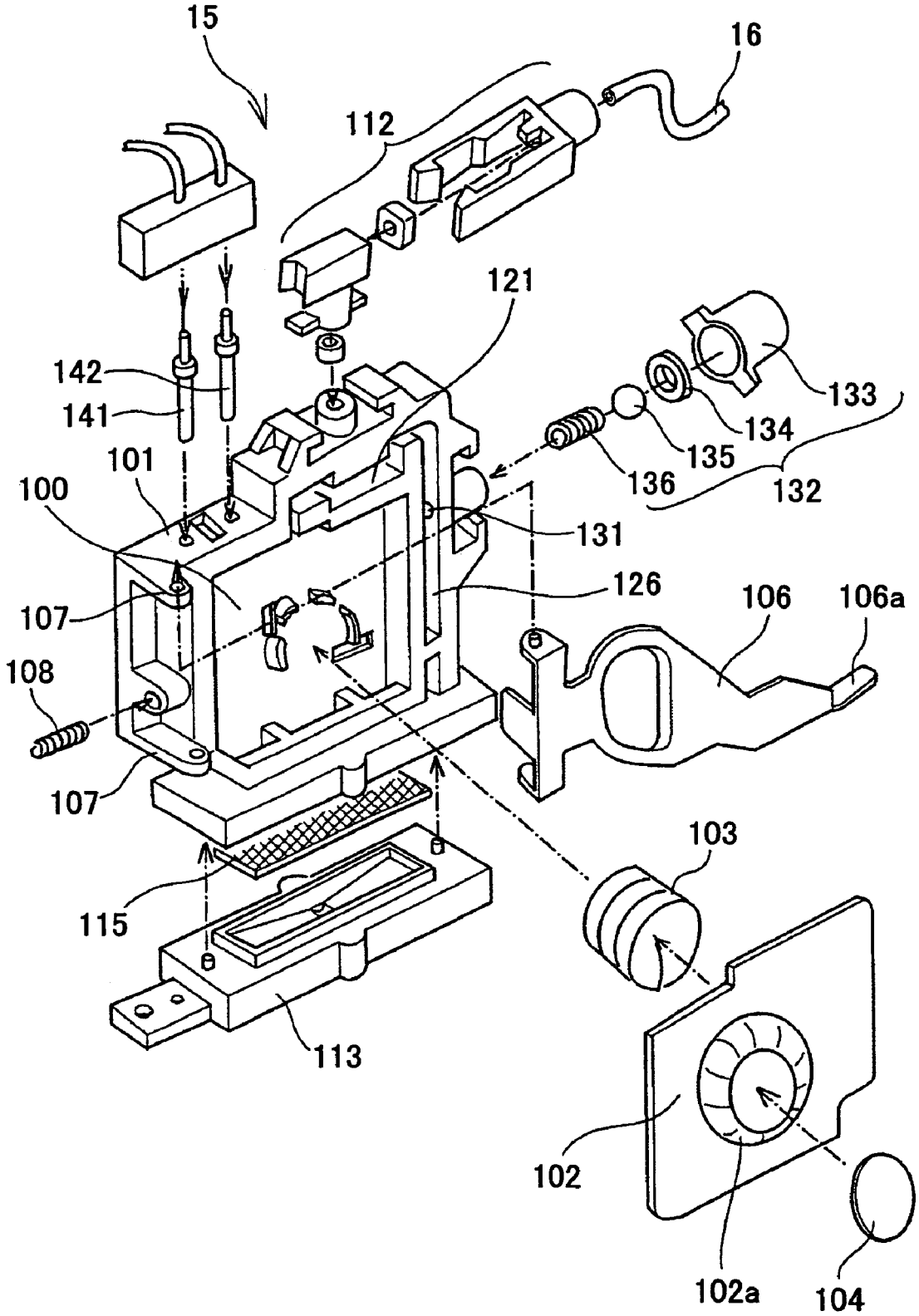
FIG. 6 is a perspective view showing components of a sub tank according to an embodiment of the present invention.
Figure 7:
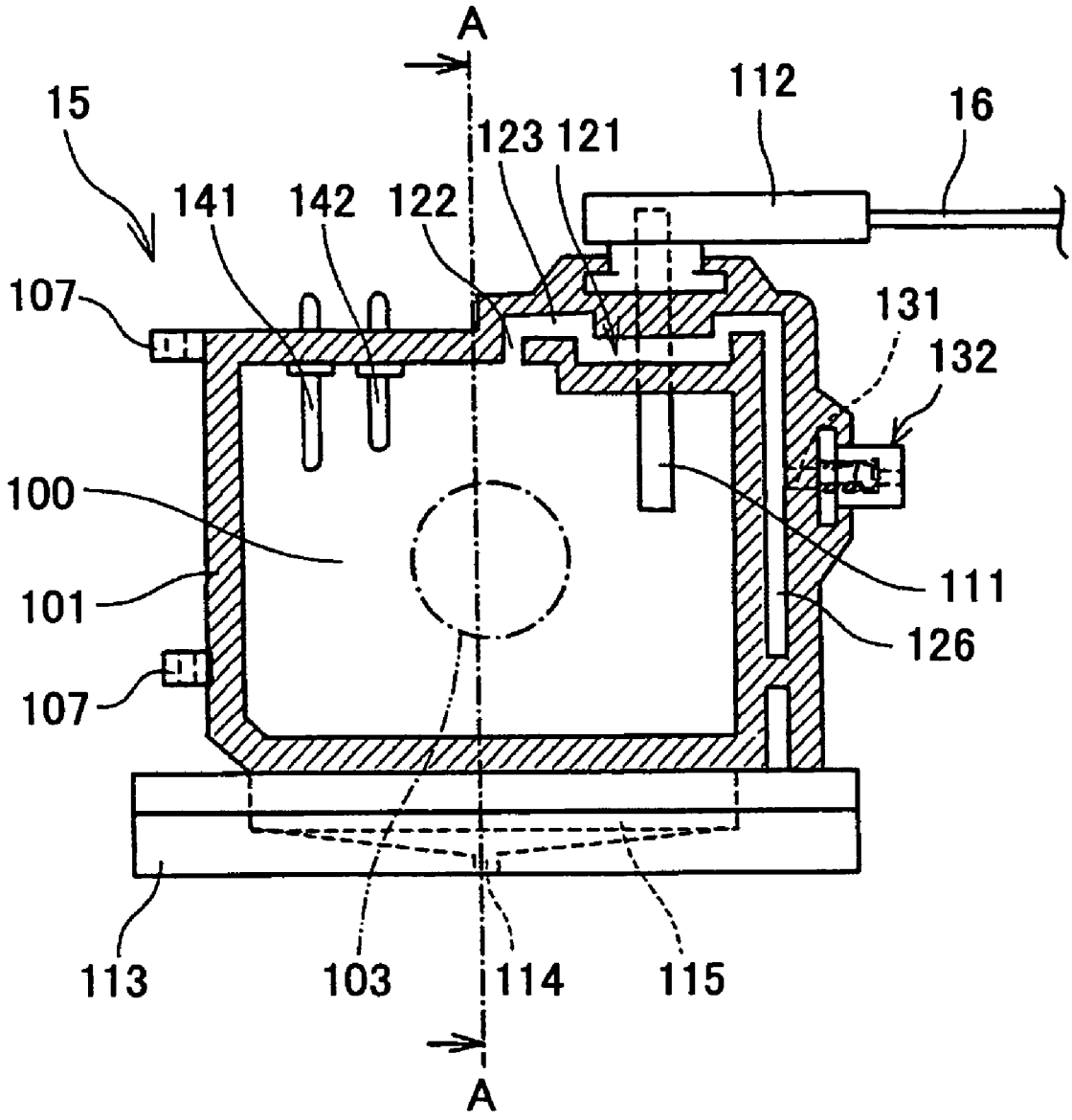
FIG. 7 is a side view showing a configuration of a sub tank according to an embodiment of the present invention.
Figure 8:
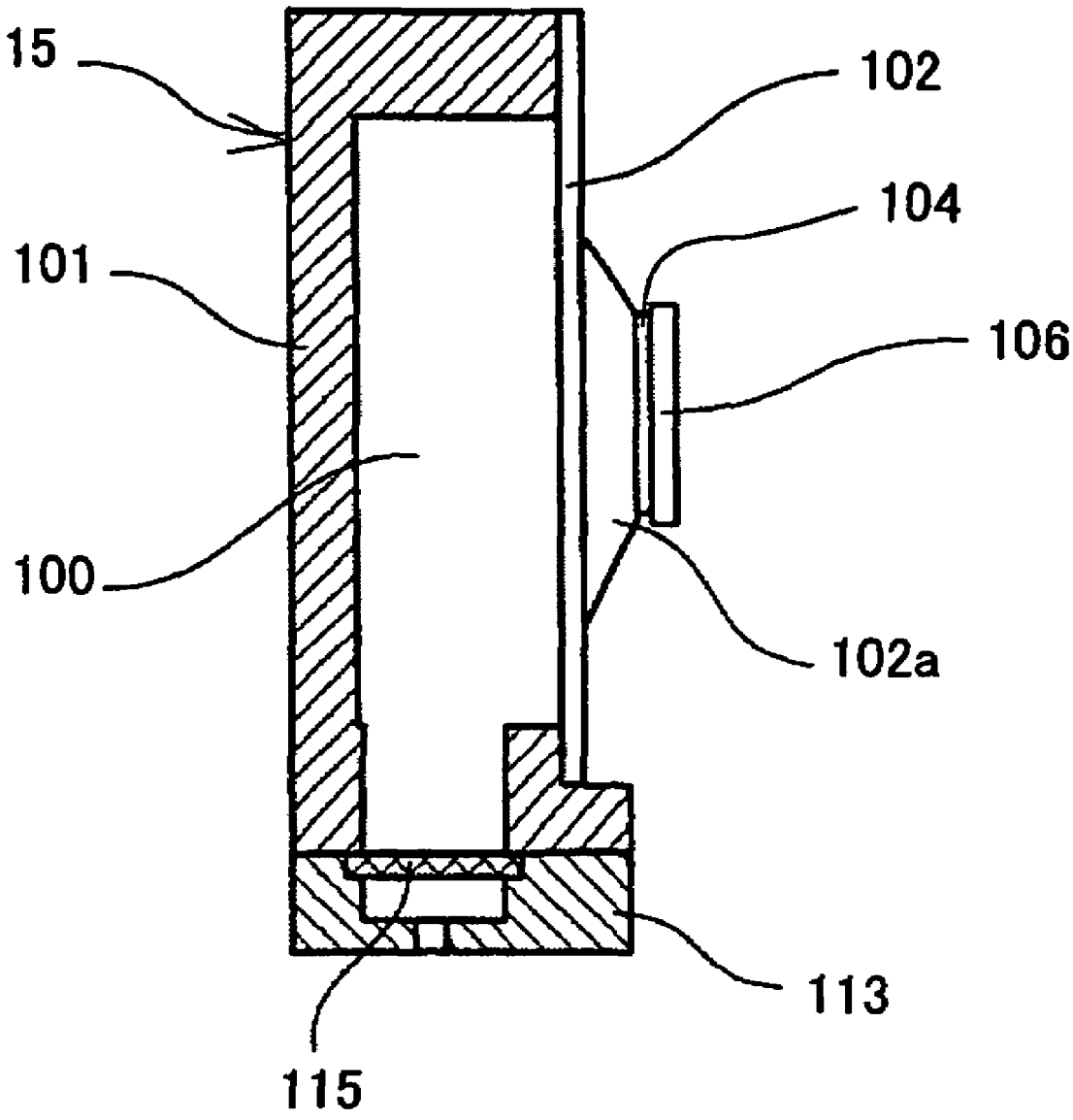
FIG. 8 is a cross-sectional view of the sub tank taken along the line A-A of FIG. 7
Figure 9A:
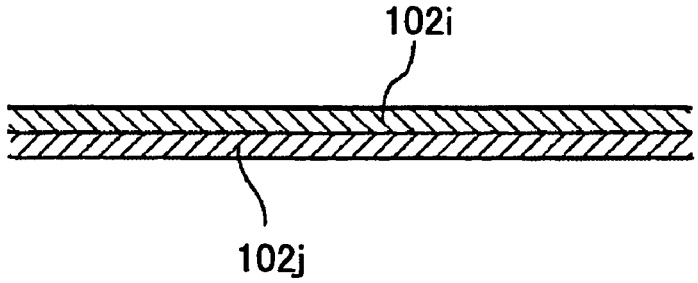
FIGS. 9A~9C are diagrams illustrating exemplary configurations of a film member that may be used in the sub tank of FIG. 7.
Figure 9B:
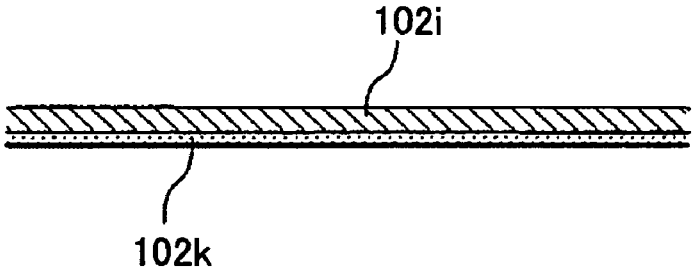
Figure 9C:
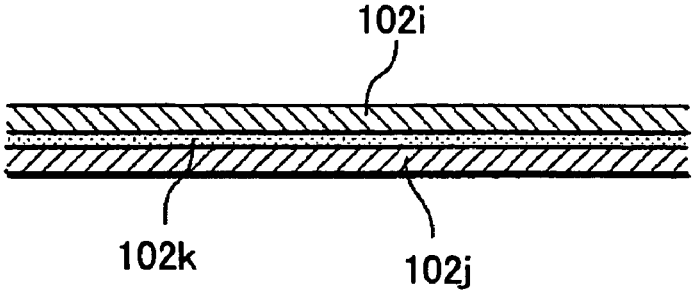
Figure 10:
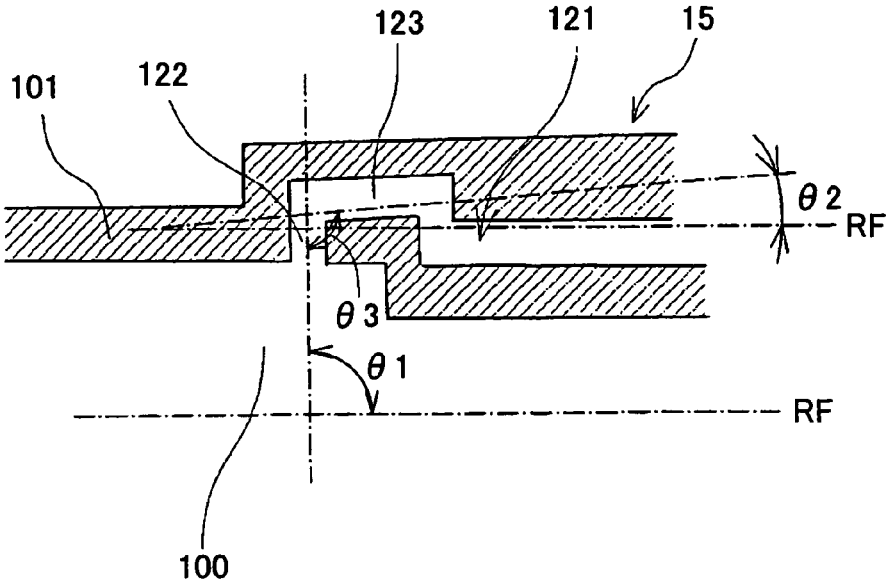
FIG. 10 is an enlarged view of an air flow path portion of the sub tank of FIG. 7.

FIG. 4 shows a perspective view of components of an ink supply apparatus according to one embodiment. FIG. 5 shows a perspective view of components of an ink supply apparatus according to another embodiment. FIG. 6 shows a perspective view of components of a sub tank 15 that may be implemented in the ink supply apparatuses of FIG. 4 and FIG. 5. FIG. 7 shows a side view of the sub tank. FIG. 8 shows a cross-sectional view of the sub tank of FIG. 7 cut across line A-A'. FIGS. 9A~9C illustrate exemplary configurations of a film member used in the sub tank of FIG. 7. FIG. 10 shows an enlarged view of an air flow path portion of the sub tank 15 of FIG. 7. It is noted that the hatchings in FIGS. 7, 8, and 10 are for facilitating recognition of the air flow path, and are not indications of cross-sections.

The ink supply apparatus is accommodated in the carriage 13 as described above, and includes a sub tank 15 for supplying ink to the recording heads 14, and a main tank (ink cartridge) 10 for supplying ink to the sub tank 15 via a supply tube 16.

The sub tank 15 includes a container main body (case) 101 that forms an ink accommodating portion 100, and a flexible film member 102 that seals the opening of the ink accommodating member 101. The film member 102 may be attached to the ink accommodating member 100 through bonding or welding, for example. Also, a spring 103 is placed between the case 101 and the film member 102 to force the film member 102 outward, and this corresponds to a negative pressure generating unit for generating negative pressure in response to the supplying and discharging of liquid.

The film member 102 may have a single layer structure, or more preferably, a multi-layer structure as is illustrated in FIGS. 9A~9C. FIG. 9A shows a case in which the film member 102 is arranged to have a dual-layer structure that is formed by laminating a first layer 102*i* and a second layer 102*j*. For example, a polyethylene film and nylon film may be laminated. FIG. 9B shows a case in which a silica vapor deposition layer 102*k* is formed on the first layer 102*i*. FIG. 9C shows a case in which the silica vapor deposition layer 102*k* is formed between the first layer 102*i* and the second layer 102*j*.

By arranging the film member 102 to be made of more than one layer, wetting resistance with respect to the ink being accommodated and mechanical strength may be improved. For example, in the case of FIG. 9A, if a polyethylene film and a nylon film are laminated to form the dual-layer film member, polyethylene may be arranged on the side that comes into contact with the ink. This is because polyethylene has good wetting resistance characteristics and moisture permeability but comparatively inferior air permeability, mechanical strength and flexibility. Thus, by layering a nylon film over the polyethylene film, the weakness of the polyethylene may be compensated for.

When the film member 102 is arranged to include a silica vapor deposition layer, as in the examples of FIG. 9B and FIG. 9C, moisture and air permeability of the film member 102 may be improved.

It is noted that the thickness of the film member 102 is preferably within a range of 10~100 μm. When the thickness of the film member 102 is below 10 μm, the film member may be susceptible to damage over time. When the thickness of the film member 102 is over 100 μm, flexibility of the film member 102 may be decreased, and efficient generation of the negative pressure may be hindered.

It is also noted that the film member 102 has a raised or protruding portion 102*a* that protrudes outward in response to the force of the spring 103, and a reinforcement member 104 is attached to the outer surface of this protruding portion 102*a* to add strength to this portion 102*a* (see FIGS. 6 and 8). By forming the protruding portion 102*a* on the flexible film 102, and arranging this portion to be pushed inward as the ink is consumed, the capacity of the sub tank may be changed. In such case, a corresponding portion of the flexible film member 102 may be molded into a convex shape so that the raised portion 102*a* may be easily formed.

At the outer side of the film member 102, a negative pressure lever 106 that may be displaced according to the deformation of the film member 102 is connected to support portions 107 that are positioned at one side of the case 101. The negative pressure lever 106 is forced toward the film member 102 contacting side by means of a spring 108 that is implemented between the negative pressure lever 106 and the case 101.

The case 101 includes an ink introduction path portion 111 for supplying ink to the ink accommodating portion 100, and a connection unit 112 may be detachably mounted onto the case 101 to connect the ink introduction path portion 111 to the supply tube 16, which is connected to the ink cartridge (main tank) 10. It is noted that a liquid transfer pump (liquid transfer mechanism) is implemented between the ink cartridge 10 and the sub tank 15 for pressurizing the ink to send this ink from the ink cartridge 10 to the sub tank 15. A detailed description of the liquid transfer pump is described later.

At the bottom portion of the case 101, a connecting member 113 for supplying ink to the recording heads 14 from the ink accommodating portion 100 is provided. An ink path 114 for the recording head 14 is formed at the connecting member 113, and a filter 115 is placed between the ink accommodating portion 100 and the connecting member 113.

At the upper portion of the case 101, an air flow path 121 for discharging air from the ink accommodating portion 100 is provided. The air flow path 121 includes an entrance flow path portion 122 of which an opening is connected to the ink accommodating portion 100, and a continued flow path portion 123 (referred to as 'cross flow path portion') that continues from the entrance flow path portion 122. The air flow path 121 is connected to an atmospheric release hole 131 provided at the downstream side of the case 101, and is also connected to an accumulation portion 126 that is at a lower position than the atmospheric release hole 131.

The atmospheric release hole 131 includes an atmospheric release valve mechanism 132 corresponding to a means for switching the interior state of the sub tank 15 between a sealed state to an atmospheric release state. The atmospheric release valve mechanism 132 includes a holder 133 that accommodates a valve seat 134, a ball 135 corresponding to a valve, and a spring 136 that forces the ball 135 toward the valve seat 134.

The accumulation portion 126 is for accumulating ink entering the air flow path portion 121. When the recording apparatus implementing the sub tank 15 is tilted or shaken, for example, it is highly likely that the ink will enter into the air flow path 121. Accordingly, by arranging the ink entering into the air flow path 121 to be accumulated in the accumulation portion 126, the ink may be prevented from entering into the atmospheric release hole 131 and the atmospheric release valve mechanism 132 that opens and closes this hole 131 so that problems in the operation of the atmospheric release valve mechanism 132 may be avoided even when ink penetrates into the air flow path 121 when the apparatus is dropped during its transportation, for example.

Also, detection electrodes 141 and 142 are placed on the upper side of the case 101 for detecting whether the amount of gas within the sub tank 15 has reached a predetermined level. The amount of gas may be detected based on a change occurring in the conduction state between the detection electrodes 141 and 142 depending on whether both of the detection electrodes 141 and 142 are in contact with the ink in the sub tank 15 or at least one of the detection electrodes 141 or 142 does not reach the liquid level of the ink.

In the ink supply apparatus of FIG. 4, a negative pressure pin 151 and an atmospheric release pin 153 are movably arranged with respect to the sub tank 15. The negative pressure pin 151 is forced to a non-operation state by an elastic member (spring) 152 and is used for applying pressure to an end portion 106*a* of the negative pressure lever 106 of the sub tank 15 to operate the negative pressure lever 106. The atmospheric release pin 153 is used for forcing the ball 135 of the atmospheric release mechanism 132 against the spring 136 to release air into the atmosphere.

In an ink supply apparatus having the above-described configuration, the negative pressure lever 106 of the sub tank 15 is operated against the spring 103 by means of the negative pressure pin 151, and in this state, the ink is supplied to the sub tank 15, after which the negative pressure lever 106 is released so that the flexible film member 102 is restored to its original form by the spring 103 and the capacity of the sub tank 15 (ink accommodating portion 100) is thereby increased. Herein, by keeping the atmospheric release valve mechanism 132 closed, a negative pressure may be generated within the ink accommodating portion 100.

The atmospheric release hole 131 may be opened by forcing the ball 135 of the atmospheric release valve mechanism 132 by means of the atmospheric release pin 153, and ink may be supplied to the ink accommodating portion 100 in this state so that the air in the ink accommodating portion 100 may be discharged via the air flow path 121 and out of the atmospheric release hole 131.

In the ink supply apparatus of FIG. 5, the negative pressure pin 151 and the spring 152 for forcing the negative pressure lever 106 are not used, and the negative pressure lever 106 may be used to detect the replenishing state of ink. In this case, the end portion 106*a* of the negative pressure lever 106 may correspond to a simple detection end having a sensor (not shown). Since the negative pressure lever 106 may be displaced according to the deformation of the film member 102, namely, the capacity change of the sub tank 15, the amount of ink in the sub tank 15 may be detected by detecting the position of an end portion 106*a* of the negative pressure lever 106.

In the following, a detailed description of the air flow path 121 of the sub tank 15 is given with reference to FIG. 10.

Given that the liquid level of ink in the ink accommodating portion 100 at a standstill state denotes a reference plane RF, the air flow path 121 is arranged such that the flow path central axis of the entrance flow path portion 122 is approximately perpendicular to the reference plane RF ($\theta 1 \approx 90°$), and the cross flow path portion 123 continuing from the entrance flow path portion 122 extends in an upper diagonal direction with respect to the reference plane RF (the angle $\theta 2$ formed by a plane parallel to the reference plane RF and a bottom plane of the cross flow path portion 123 is greater than 0 degrees, i.e., $\theta 2 > 0°$).

In this case, since the entrance flow path portion 122 is arranged to be approximately perpendicular to the ink liquid level (reference plane RF), owing to the effects of surface tension, ink may be prevented from entering the flow path. The effects of surface tension are weakened with the increase in the slanting of the flow path so that ink may easily enter the flow path. However, it is noted that the ink liquid level fluctuates when the ink is shaken by the scanning of the carriage 13, and it is not possible to completely prevent the ink from entering the flow path even when the entrance flow path portion 122 is arranged to be perpendicular to the reference plane RF. Still, it is preferable that the entrance flow path 122 be perpendicular in order to reduce the amount of ink entering the flow path.

By arranging the cross flow path 123 continuing from the entrance flow path portion 122 to extend in an upper diagonal direction with respect to the reference plane RF, ink may be prevented from entering into the cross flow path 123 even when the ink enters the entrance flow path portion 122 due to fluctuation of the ink liquid level caused by vibration of the sub tank 15 and/or the capillary effect, for example. Further, even when the ink enters the cross flow path 123, the ink tends to flow back toward the entrance flow path portion 122 owing to its own weight.

In this way, the entering of ink into the air flow path 121 may be reduced, and ink entering the air flow path 121 may be prevented from reaching the atmospheric release valve mechanism 132, sticking to the ball 135 and the valve seat 134, and debilitating the sealing function of the valve mechanism 132, for example.

With regard to the entrance flow path portion 122 and the cross flow path portion 123, when the angle $\theta 1$ formed by entrance flow path portion 122 with respect to the reference plane RF is 90 degrees, given that the angle formed by the cross flow path portion 123 with respect to the entrance flow path portion 122 is denoted as $\theta 3$, $90° < \theta 3 \leqq 180°$. When the angle $\theta 1$ formed by the entrance flow path portion 122 with respect to the reference plane RF is less than 90 degrees $(90°-\alpha°)$, $(90°+\alpha°) < \theta 3 \leqq (180°+\alpha°)$. When the angle $\theta 1$ formed by the entrance flow path portion 122 with respect to the reference plane RF is less than 90 degrees $(90°+\beta°)$, $(90°-\beta°) < \theta 3 \leqq (180°-\beta°)$.

To obtain the effects of gravitational fall of the ink, the angle $\theta 3$ may be set to $\theta 3 = 180°$, for example, according to the above conditions. In other words, the entrance flow path portion 122 may be arranged to extend upward instead of arranging the cross flow path portion 123; however, in such case, the atmospheric release valve mechanism 132 has to be placed above the sub tank 15, and this configuration may be a detriment to miniaturizing the sub tank 15 and the mechanism for releasing air therefrom.

Accordingly, the angle formed by the cross flow path portion 123 and the entrance flow path portion 122 is preferably arranged to be close to 90 degrees ($\theta 3 < 180°$) so that the ink supply path (portion connected to the supply tube 16) and the atmospheric release valve mechanism 132 may be arranged at different sides of the sub tank 15, and the size of the sub tank 15 may be reduced.

The liquid level of ink close to the entrance flow path portion 122 of the air flow path 121 fluctuates with the movement of the carriage 13, and thereby ink is prone to enter the entrance flow path portion 122. Accordingly, the length of the entrance flow path portion 122 is preferably set to a length that may not allow ink entering into the entrance flow path portion 122 to penetrate further into the cross flow path portion 123. In this way, ink entering the entrance flow path portion 122 due to movement of the carriage 13 may be prevented from reaching the cross flow path portion 123.

According to testing results, by arranging the path length of the entrance flow path portion 122 to be at least 2.5 mm, ink may be prevented from entering the cross flow path portion 123 when the liquid level fluctuates due to the scanning operation of the carriage 13.

The capillary effect becomes stronger as the diameter (width) of a hole pulling up liquid is reduced, and once liquid enters the hole, the liquid may not easily flow back and out of the hole due to the generation of surface tension. Thus, if the opening of the entrance flow path portion 122 at the ink accommodating portion 100 side is narrow, ink may be pulled up into the entrance flow path portion 122 just by coming into contact with the opening of the entrance flow path portion 122 even when the ink liquid level is not fluctuating. In such case or in a case where the ink completely enters the flow path due to shaking, the ink entering the flow path may not flow back and out of the flow path.

By narrowing the flow path, the case 101 may be miniaturized, and in a resin component, the flow path may be narrowed down to 0.5~1 mm with due consideration to factors such as mold degradation. As for the sub tank 15 of the present embodiment, the narrowest portion of the flow path is arranged to have a width of 1 mm, but the opening of the entrance flow path portion 122 is arranged to be wider. According to testing results, a width of 3 mm is the point at which the capillary effect and the surface tension may be avoided. Thus, in the present embodiment, the opening of the entrance flow path portion 122 is arranged to have a width of 3.5 mm. However, the present invention is not limited to this embodiment, and the opening at the sub tank 15 may be arranged to have any width as long as the capillary effect and the surface tension may be avoided.

In the present embodiment, the cross section area of the opening of the entrance flow path portion 122 is arranged to be greater than the cross section area of the continuing cross section flow path portion 123. Thereby, the cross flow path portion 123 may be narrowed while the entrance flow path portion 122 is arranged so that the capillary effect and the surface tension may be avoided.

In the following, a sub tank 15' corresponding to a liquid container according to another embodiment of the present invention is described with reference to FIGS. 11 through 14.

Figure 11:
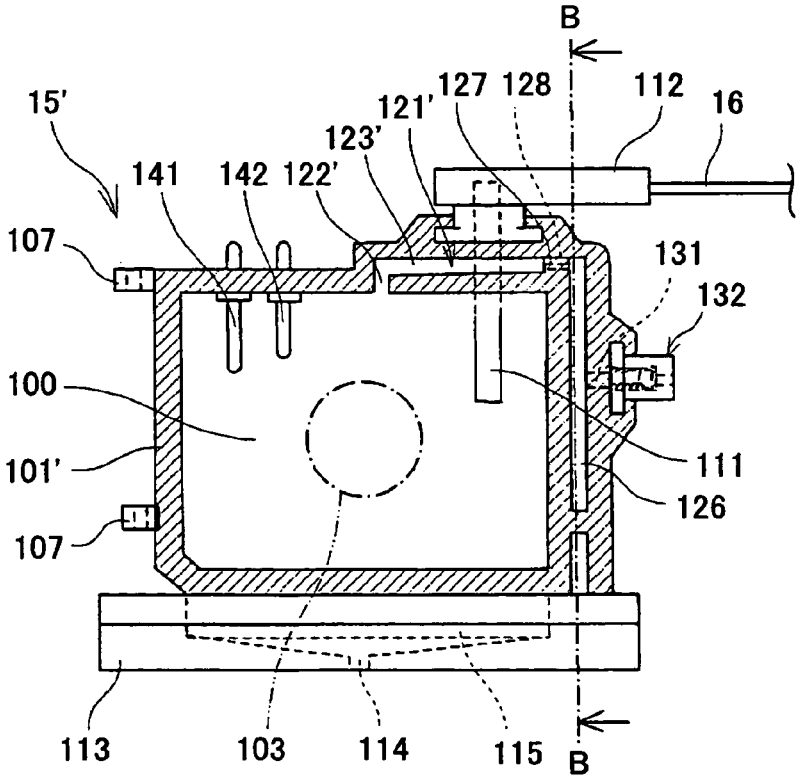
FIG. 11 is a side view of a sub tank according to a variation embodiment of FIG. 7.
Figure 12:
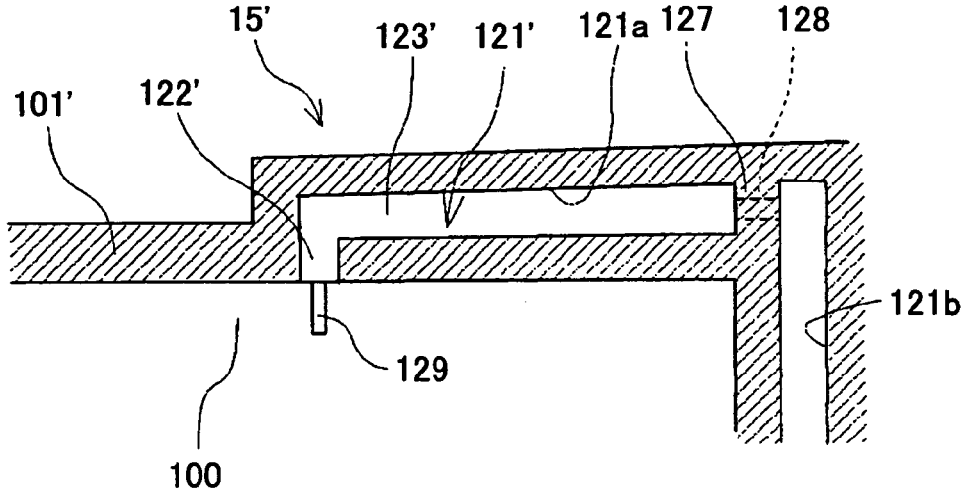
FIG. 12 is an enlarged view of an air flow path portion of the sub tank of FIG. 11.
Figure 13:
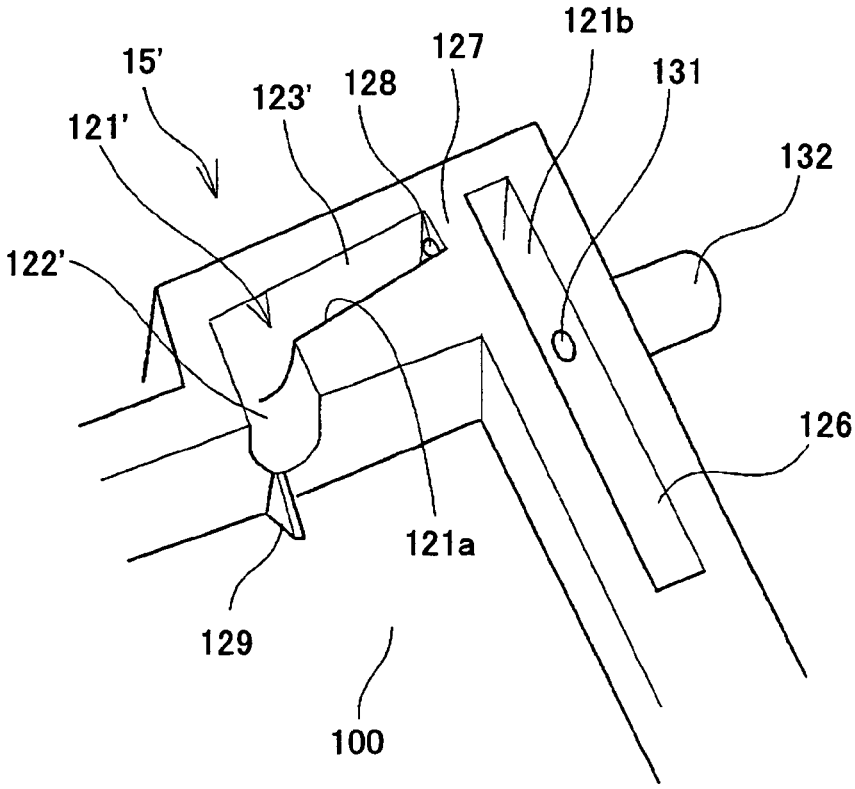
FIG. 13 is a perspective view of the air flow path portion of the sub tank of FIG. 11.
Figure 14:
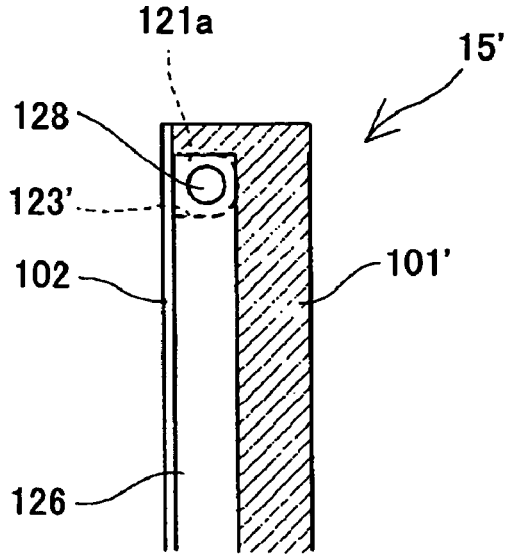
FIG. 14 is a cross-sectional view of the air flow path portion of the sub tank taken along the line B-B of FIG. 11.

FIG. 11 shows a side view of the sub tank 15' of the present embodiment, FIG. 12 shows an enlarged view of an air flow path portion of the sub tank 15' of FIG. 11, FIG. 13 shows a perspective view of the air flow path portion, and FIG. 14 shows a cross-sectional view of the air flow path portion of the sub tank 15' of FIG. 11 cut across line B-B'.

In the sub tank 15' of the present embodiment, an air flow path 121' is formed at a case 101', and a wall 127 that blocks the air flow path 121' midway is formed so that the air flow path 121' may be divided into trench 121*a* and trench 121*b*. The air flow path 121' also includes a through hole 128 that is formed at the wall 127 to connect the trenches 121*a* and 121*b*. The side wall of the through hole 128 is arranged to be discontinuous from the side wall of the trench 121*a* as is illustrated in FIG. 14.

According to the present embodiment, a trench is formed at the case 101'as the air flow path 121', and a flexible film member 102 is attached to the case 101 to seal the open side of the trench. Thus, the flexible film member 102 forms side walls of the trenches 121*a* and 121*b*. However, the film member 102 does not form a side wall at the portion where the wall 127 is formed, namely, at the through hole 128. In a configuration where a film member seals a trench to form a side wall of an air flow path, ink may penetrate into the air flow path along side wall portions of the air flow path at which the film member and the trench are bonded, this being attributed to the capillary effect. Thereby, in the present embodiment, the air flow path 121' is arranged to include a portion that does not have a side wall formed by the film member 102 so that ink entering due to the capillary effect may be blocked, and hindered from entering the atmospheric release hole 131.

Figure 15:
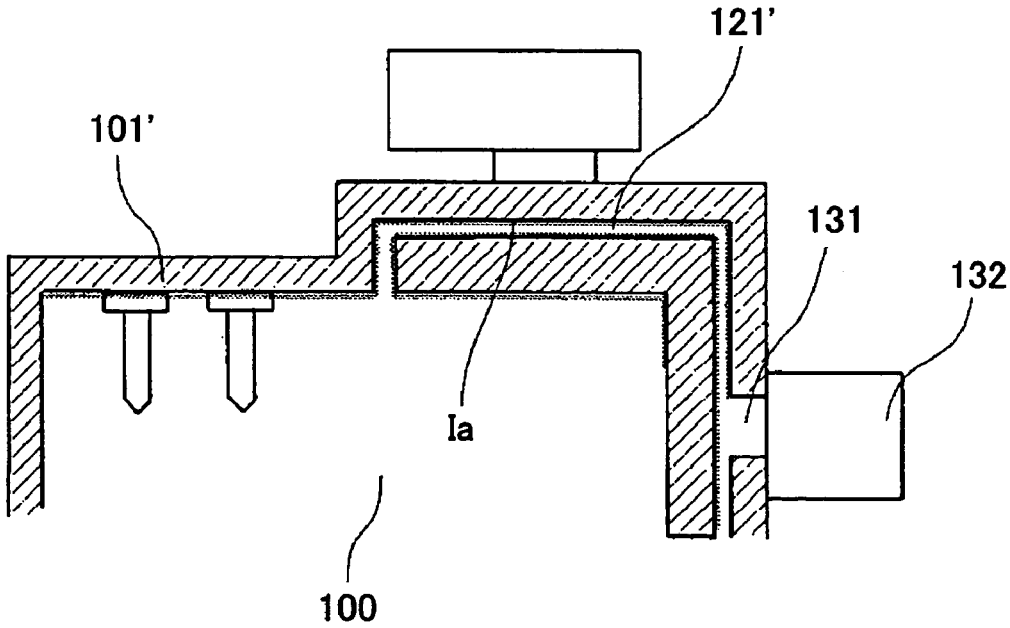
FIG. 15 is a diagram illustrating the capillary effect.
Figure 16:
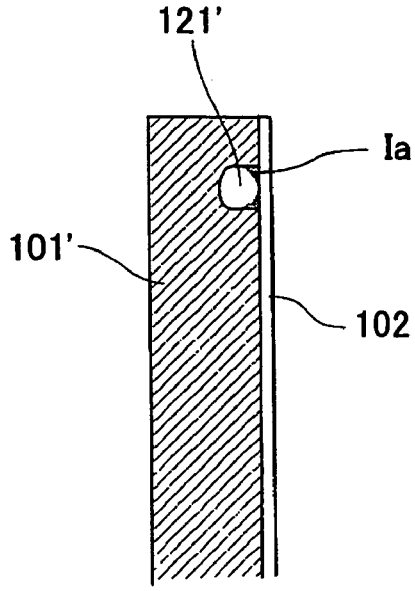
FIG. 16 is a cross-sectional view of FIG. 15.

In the following, the above mechanism is described in detail. Referring to FIGS. 15 and 16, ink Ia is easily conveyed along corner portions formed by the film member 102 and the case 101' owing to the capillary effect, and as a result, the ink Ia may penetrate into the air flow path 121' along the corner portions to reach the atmospheric release hole 131.

Figure 17:
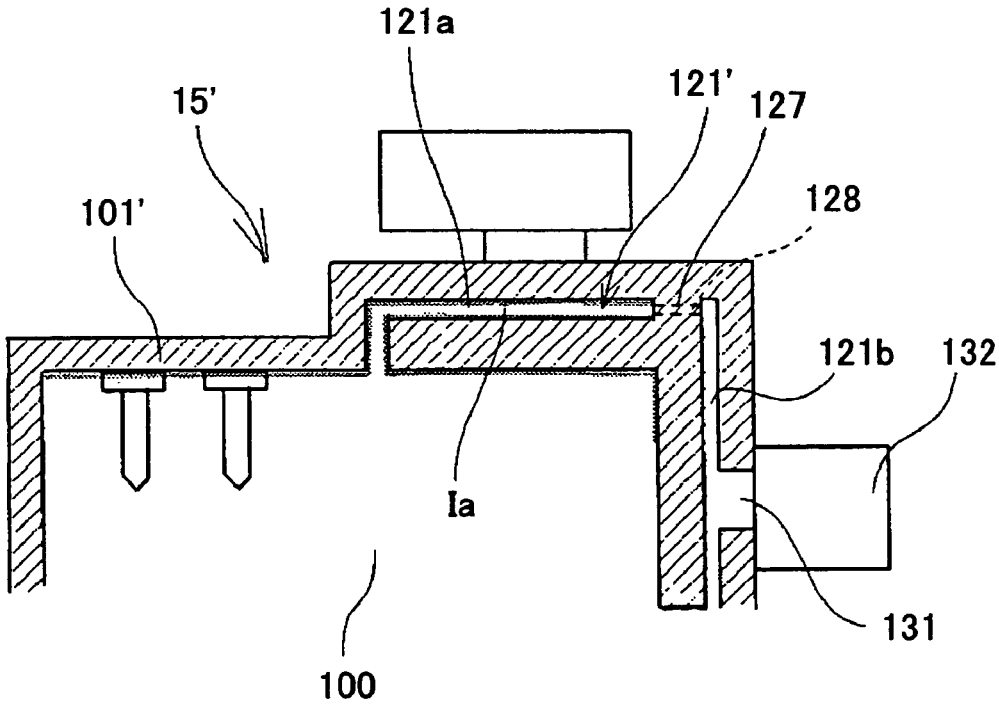
FIG. 17 is a partial side view of the sub tank of FIG. 11 illustrating the capillary effect.

Accordingly, as is shown in FIG. 17, the air flow path 121' is arranged to include the through hole 128 at which the film member 102 does not form a side wall so that even when the ink Ia penetrates into the air flow path 121' owing to the capillary effect, the penetration of ink may be stopped at the wall 127 configuring the through hole 128, and the ink may be prevented from penetrating further into the air flow path 121'.

In the present embodiment, the wall 127 is arranged so that the through hole 128 may be positioned away from portions at which the capillary effect is likely to occur, namely, the edge line portions of the air flow path 121 formed by the film member 102 and the trench portion 121*a* of the case 101'. In this way, the ink entering into the trench 121*a* side may be prevented from penetrating into the through hole 128.

When the diameter of the through hole 128 is relatively large, the through hole 128 may effectively block the penetration of ink due to the capillary effect; however, in this case, ink may easily enter the through hole 128 when vibration occurs. Thereby, the diameter and length of the through hole 128 are preferably adjusted so that ink does not pass through the through hole 128 when fluctuation of the liquid level occurs during a scanning operation.

According to testing results, the penetration of ink into the through hole 128 due to vibration may be substantially prevented by arranging the diameter of the through hole 128 to be no more than 3 mm. Also, according to testing results, the ink penetration may not be sufficiently prevented when the through hole 128 is shorter than 1 mm, and by arranging the length of the through hole 128 to be at least 1 mm, ink may be prevented from passing through the through hole 128 and penetrating into the trench 121*b* at the downstream side.

Further, in the sub tank 15' of the present embodiment, a rib 129 is arranged at an entrance flow path portion 122' of the air flow path 121' (see FIGS. 12 and 13). Depending on the diameter (width) of the entrance flow path portion 122', ink entering into the entrance flow path portion 122' due to fluctuation of the liquid ink surface may not flow out very easily owing to surface tension. In the present embodiment, the entrance flow path portion 122' is arranged to have a diameter (width) of 3.5 mm so that ink may fall out instead of accumulating. However, it takes time for the surface tension to break to thereby let the ink fall. Accordingly, by placing the rib 129 in the vicinity of the opening of the entrance flow path portion 122', the surface tension may be broken, and the time required for the ink to fall may be reduced.

Generally, liquid that enters a narrow path with a small diameter tends to accumulate in the path and is less likely to fall even when the liquid is detached from the liquid level. This is due to the effects of surface tension, but when an outside element comes into contact with the portion at which this surface tension is in effect, the surface tension can be broken, to thereby cause the ink in the path to fall. Accordingly, the sub tank 15' of the present embodiment implements the rib 129, which comes into contact with the ink surface formed close to the opening of the entrance flow path portion 122 where surface tension is in effect. The rib 129 may have any configuration as long as it comes into contact with ink forming a membrane-like surface owing to the effects of surface tension.

In the following, the accumulation portion 126 is described in detail. In the sub tank 15' according to the present embodiment, precautionary measures are taken in order to reduce and control ink penetration into the air flow path 121'. However, when the recording apparatus is tilted or shaken, it is highly possible for the ink penetration to occur in spite of such measures.

The accumulation portion 126 is provided so that ink that passes through the through hole 128 and penetrates into the trench 121*b* may accumulate therein. Thereby, even when ink penetrates into the down stream portion of the air flow path 121' due to dropping or falling of the recording apparatus upon its transportation, for example, the ink may be prevented from entering the atmospheric release hole 131 and the atmospheric release valve mechanism 132 that opens and closes this release hole 131.

Figure 18:
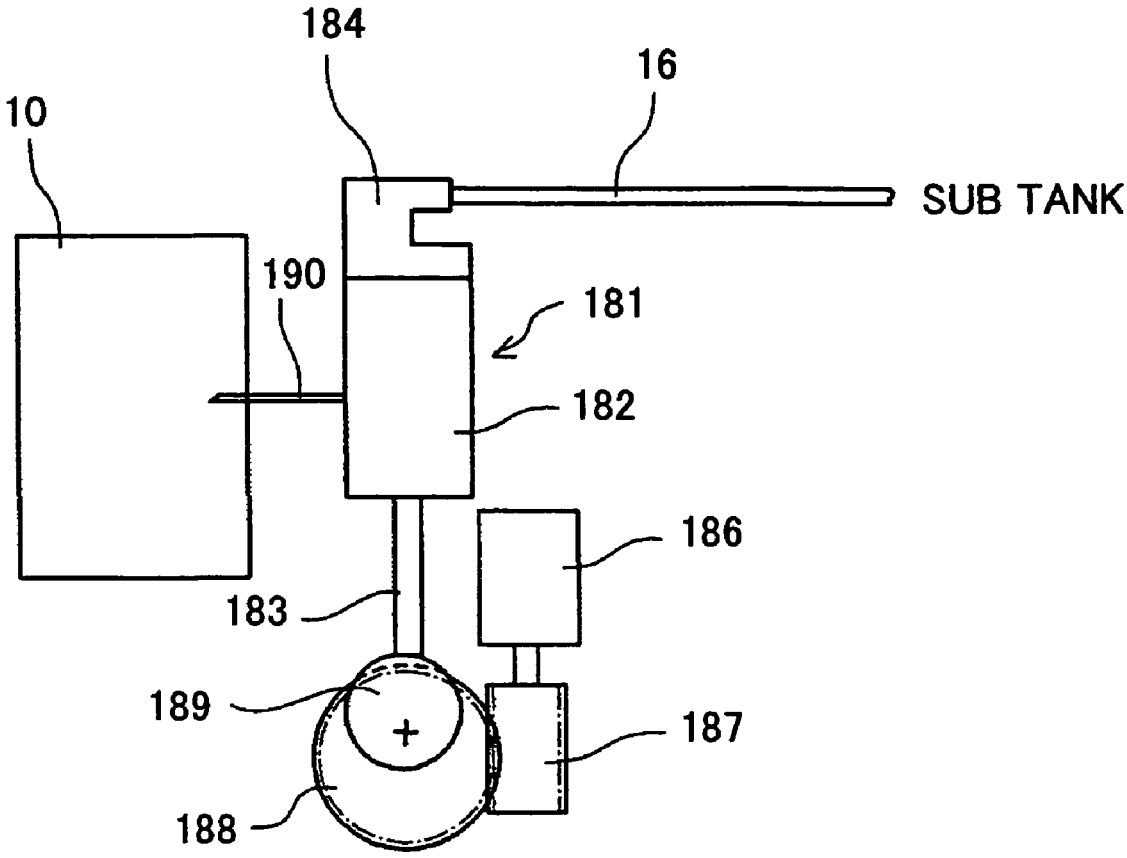
FIG. 18 is a schematic diagram showing a liquid transfer mechanism for transferring liquid to a sub tank according to an embodiment of the present invention.

In the following, detailed descriptions are given of the liquid transfer mechanism for transferring ink from the ink cartridge (main tank) 10 to the sub tank 15 with reference to FIG. 18.

The liquid transfer mechanism includes a piston pump 181. The piston pump 181 includes a cylinder 182 and a piston 183. The cylinder 182 is connected to one end of a hollow needle 190 of which the other end is inserted into an ink discharge outlet portion of the ink cartridge (main tank) 10. The piston pump 181 also includes a connection portion 184 that connects the supply tube 16 to the cylinder 182.

The piston 183 is driven back and forth by a cam 189 that is integrated with a worm wheel 188, which is driven and rotated via a worm gear 187 by the rotation of a drive motor 186.

In the liquid transfer mechanism as described above, when the piston pump 181 is operated, a negative pressure is generated so that ink in the ink cartridge 10 may be guided into the cylinder 182 via the hollow needle 190 that is inserted into the ink cartridge 10. The ink that enters the cylinder 182 is then carried through the connection portion 184 and into the sub tank 15 via the supply tube 16, this being realized by the pumping motion of the piston 183.

Figure 19:
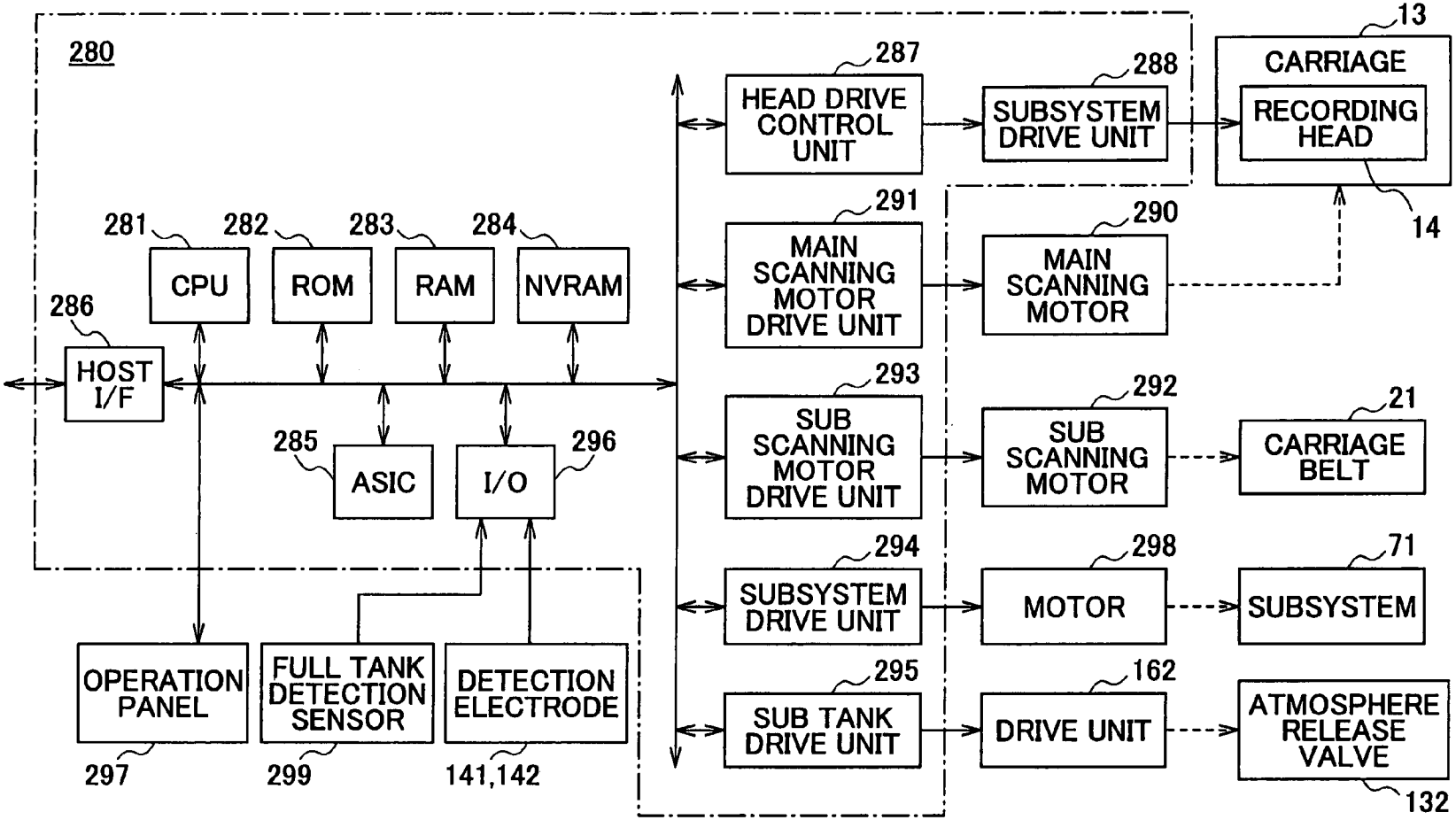
FIG. 19 is a block diagram showing a configuration of a control unit implemented in the recording apparatus of FIG. 1.

In the following, a control unit 280 of an imaging apparatus according to an embodiment of the present invention is described with reference to FIG. 19.

The control unit 280 may include a CPU 281 that administers overall control of the apparatus, programs that are executed by the CPU 281, a ROM 282 that stores fixed data, a RAM 283 that temporarily holds data such as image data, a non-volatile memory (NVRAM) 284 for retaining data even when the power of the apparatus is turned off, and an ASIC 285 that conducts various signal processes on image data, image processes for rearranging image data, and processing of other input signals for controlling the apparatus, for example.

The ROM 282 may store information pertaining to a liquid discharge amount and an absorption amount, or information pertaining to a liquid discharge amount for a specific discharge pattern and an absorption amount, and information pertaining to a capacity of the sub tank 15, for example. Alternatively, such information may be stored within a print driver, for example, in the form of software. The non-volatile memory 284 may store an amount of ink consumption or an amount of ink in the sub tank based on the above information, for example.

The control unit 280 may also include an I/F 286 for transmitting and receiving signals, a head drive control unit 287 and a head driver 288 for driving and controlling the recording head 14, a main scanning motor drive unit 291 for driving a main scanning motor 290, a sub scanning motor drive unit 293 for driving a sub scanning motor 292, a subsystem drive unit 294 for driving a motor 298 that drives a suction pump for conducting the absorption operation from the suction cap 72*a* of the subsystem 71, a sub tank drive unit 295 for driving a drive unit 162 for opening the sub tank 15 to the atmosphere, and an I/O 296 for inputting detection signals from various sensors such as the detection electrodes 141 and 142 of the sub tank 15, and possibly a full tank detection sensor 299 (i.e., in the embodiment of FIG. 5).

The full tank detection sensor 299 may be placed at the end portion 106*a* of the negative pressure lever 106 of the sub tank 15, as is described with reference to the case of FIG. 5. The full tank detection sensor 299 may be adapted to detect whether the end portion 106*a* is at a predetermined position. Accordingly, when the sub tank 15 is being supplied with ink, the full tank detection sensor 299 may be used to determine and signal when the sub tank 15 is filled up to full capacity.

The control unit 280 is also connected to an operations panel 297 for inputting and displaying information to be utilized by the apparatus.

The control unit 280 receives print data at the I/F 286 from a host via a cable or a network. The host may correspond to an information processing apparatus such as a personal computer, an image reading apparatus such as an image scanner, and an image capturing apparatus such as a digital camera, for example.

The CPU 281 reads and analyzes print data stored in a reception buffer of the I/F 286, administers the ASIC 285 to conduct image processes and data rearrangement as necessary or desired, and sends the image data to the head drive control unit 287. It is noted that the generation of dot pattern data for image output may be conducted by storing font data in the ROM 282, or the image data may be arranged to be developed into bit map data at a printer driver of the host and sent to the control unit 280.

Upon receiving image data of one line to be recorded by the recording head 14 (dot pattern data), the head drive control unit 287 synchronizes the dot pattern data of one line with a clock signal, and sends the resulting data as serial data to the head driver 288. The head drive control unit 287 also sends a latch signal to the head driver 288 at a predetermined timing.

The head drive control unit 287 may include a ROM (which may correspond to the ROM 282) that stores pattern data of a drive waveform (drive signal), a waveform generating circuit implementing a D/A converter that performs D/A conversion on the data of the drive waveform that are read from the ROM, and a drive waveform generating circuit implementing elements such as an amplifier.

The head driver 288 may include, for example, a shift register for inputting the clock signal from the head drive control unit 287 and the serial data corresponding to the image data, a latch circuit for latching a register value of the shift register based on the latch signal from the head drive control unit 287, a level conversion circuit (level shifter) for changing the level of an output value of the latch circuit, and an analog switch array (switching means) that is controlled to be switched on/off by the level shifter. By conducting the on/off control of the analog switch array, a desired drive waveform that is included in the drive waveform data may be selectively applied to the actuator of the recording head 14 to drive this head.

The CPU 281 may measure the amount of liquid consumption by counting the number of liquid drops that are discharged from the recording head 14. In this case, if the liquid discharge amount according to the discharge pattern is stored, the amount of consumed liquid (amount of ink consumption) is obtained by counting the number of ink discharges made (number of drops) for each pattern.

Specifically, when information pertaining to the discharge amount and the absorption amount of liquid is stored beforehand, the amount of ink consumption (V) may be calculated based on formula (1) shown below.

$$\text{Ink consumption } V = \Sigma(\text{discharge amount} \times \text{number of discharges}) + \Sigma(\text{absorption amount} \times \text{number of absorptions}) \quad (1)$$

The sub tank 15 being a plastic structure made up of a flexible film member and an elastic member, it is quite difficult to provide means for accurately detecting the amount of liquid (ink) within the sub tank 15. Thus, by adding the amount of ink consumed upon ink discharge that is obtained from the ink discharge amount and the number of discharges, and the amount of ink consumption upon the restoration operation (absorption), a total amount of ink consumption may be easily and accurately calculated. When a number of standards exist for determining the discharge amount or the absorption amount, a product of an amount and a number of rounds for each case is calculated after which a total sum of the products is obtained.

In this case, a difference in the ink discharge amount is created between heads. Accordingly, it is preferable that the calculation value of the ink discharge amount be corrected by using a coefficient that is set beforehand according to a parameter that reflects the ink discharge characteristics of the heads. Specifically, the number of drops may be reduced for a head that discharges a large-sized ink drop, and the number of drops may be increased for a head that discharges a small-sized ink drop, and thereby the differences between apparatuses and the differences between the heads of each color as may be reduced and an even image output may realized.

Also, in a case where information pertaining to an ink discharge amount and ink absorption amount for each discharge pattern is stored beforehand, the amount of ink consumption V may be obtained according to formula (2) shown below.

$$\text{Ink consumption } V = \Sigma(\text{specific pattern discharge amount} \times \text{number of specific pattern discharges}) + \Sigma(\text{absorption amount} \times \text{number of absorptions}) \quad (2)$$

For example, discharge amount data according to tone patterns may be stored beforehand, and upon performing tone printing, the ink consumption amount may be obtained by multiplying the ink discharge amount data for the tone pattern by the number of occurrences of the tone pattern. In this way, more accurate ink amount detection (calculation) may be realized compared to the case where the discharge amount and the number of discharges are multiplied. The difference between the above formula (1) and formula (2) lies in the fact that in formula (1) a deviation is likely to occur depending on frequency characteristics of the discharge, but in formula (2) the deviation is already taken into account as data so that a more accurate detection can be realized.

In the following, an ink supply operation of this imaging apparatus with respect to the sub tank is described with reference to FIGS. 20~22.

In an ink supply apparatus of the imaging apparatus according to the present embodiment, operations for supplying ink to the sub tank 15 from the main tank 10 include an atmospheric release supply operation of arranging the sub tank 15 to be in an atmospheric release state in supplying ink thereto, and a normal supply operation that does not involve the atmospheric release of the sub tank 15 in supplying ink thereto.

Figure 20:
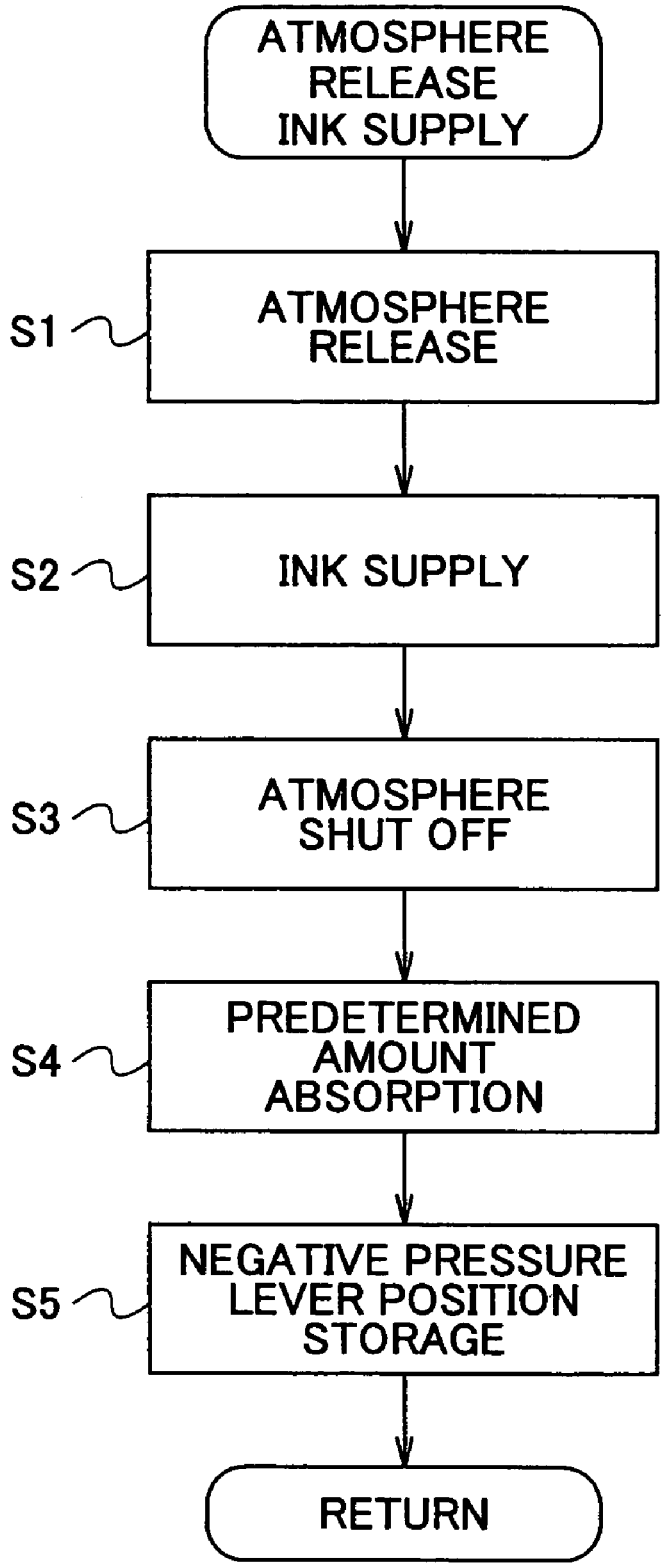
FIG. 20 is a flowchart illustrating an atmospheric release supply operation according to an embodiment of the present invention.

FIG. 20 is a flowchart illustrating the atmospheric release supply operation. In this operation, the drive unit 162 operates the atmospheric release pin 153 so that the atmospheric release valve mechanism 132 of the sub tank 15 is opened, thereby rendering the inside portion of the sub tank 15 to be in an atmospheric release state (S1). When the sub tank 15 is opened to the atmosphere, the film member 102 is pushed outward by the recovery force of the spring 103, and thereby, the capacity of the sub tank 15 increases (the negative pressure generation unit expands).

In this state, ink in the ink cartridge (main tank) 10 is transferred to the sub tank 15 through the liquid transfer mechanism (S2). After the ink supply is completed, the atmospheric release valve mechanism 132 is closed so that the inside portion of the sub tank 15 is shut off from the atmosphere (S3). Then, a nozzle surface of a corresponding recording head 14 is capped by the cap member 72*a* of the sub system 71, and the motor 298 is driven so that an absorption pump (not shown) is operated. In this way, a vacuum process is performed on the nozzles of the recording heads 14 of the sub tank 15 so that a predetermined amount of ink is absorbed therefrom (S4). In turn, the film member 102 of the sub tank 15 is pushed inward against the force of the spring 103 and the capacity of the sub tank 15 is decreased (the negative pressure generation unit is contracted) so that an initial negative pressure is generated.

Then, the full tank detection sensor 299 may detect the position of the detection end 106*a* of the negative pressure lever 106 and store this position information (S5).

It is noted that the atmospheric release supply operation may be conducted according to the other alternative procedures as described below. For example, the flexible film member 102 may be pushed inward against the spring 103 by the negative pressure lever 106 when the sub tank 15 is opened to the atmosphere, and after the capacity of the sub tank 15 is reduced, ink may be transferred from the ink cartridge 10 to the sub tank 15 through the liquid transfer mechanism. After supplying the ink to the sub tank 15, the atmospheric release valve mechanism 132 may be closed so that the inner portion of the sub tank 15 may be shut off from the atmosphere, and by releasing the pressure of the negative pressure lever 106, the flexible film member 102 may be forced outward by the bias force of the spring 103 so that a negative pressure is generated within the sub tank 15.

By using the flexible film member 102 and the elastic member (spring) 103 to generate a negative pressure within the sub tank 15 as in the above examples, the negative pressure generation mechanism may be simplified.

In the following, the normal supply operation is described. In this operation, as is described above, the amount of ink consumption V is detected (by counting the number of drops), and when the detected amount of liquid consumption reaches a predetermined level, ink is transferred from the ink cartridge 10 to the sub tank 15 through the ink transfer mechanism without opening the sub tank 15 to the atmosphere so that the desired amount of ink is supplied to the sub tank 15. The amount of ink to be supplied may be controlled by the drive time of the pump 181.

It is noted that the amount of ink to be supplied is preferably equivalent to the amount of ink consumption V; however, in practice, errors occur in the calculation of the consumption amount V due to differences in the amount of ink in one drop and the absorption amount. Also, since the ink supply is realized by the back and forth movement of the piston, the ink supply has a pulse and the amount of ink being supplied may differ depending on timing. When ink consumption and normal ink supply are repeatedly performed, the actual amount of ink within the sub tank 15 may gradually deviate from the presumed amount owing to the errors described above. In turn, a deviation may also occur in the negative pressure value within the sub tank 15.

Accordingly, as is described above, after the atmospheric release filling operation, when the initial negative pressure is generated by absorbing a predetermined amount of ink, the position of the negative pressure lever 106 is stored. As the ink in the sub tank 15 is consumed, the film member 102 contracts further, and the negative pressure lever 106 also moves toward the sub tank 15 accordingly. In the normal supply operation, the full tank detection sensor 299 may recognize that the negative pressure lever 106 is placed back to its initial position that is stored, and the supply operation may be ended accordingly. In this way, errors due to differences in the actual ink amounts as described above may be reduced, and the negative pressure may be returned at its initial negative pressure right after the normal supply operation.

As is described above, the operation of opening the sub tank 15 to the atmosphere to supply ink (atmospheric release supply operation) does not have to be performed each time ink is depleted in the sub tank 15. Moreover, this operation may be performed when the amount of ink consumption reaches or exceeds a predetermine amount, and in other cases, the normal supply operation of supplying ink to the sub tank 15 without opening the sub tank 15 to the atmosphere is preferably performed.

In the following, a detailed description of an ink supply operation according an embodiment of the present invention is given with reference to FIGS. 21 and 22.

Figure 21:
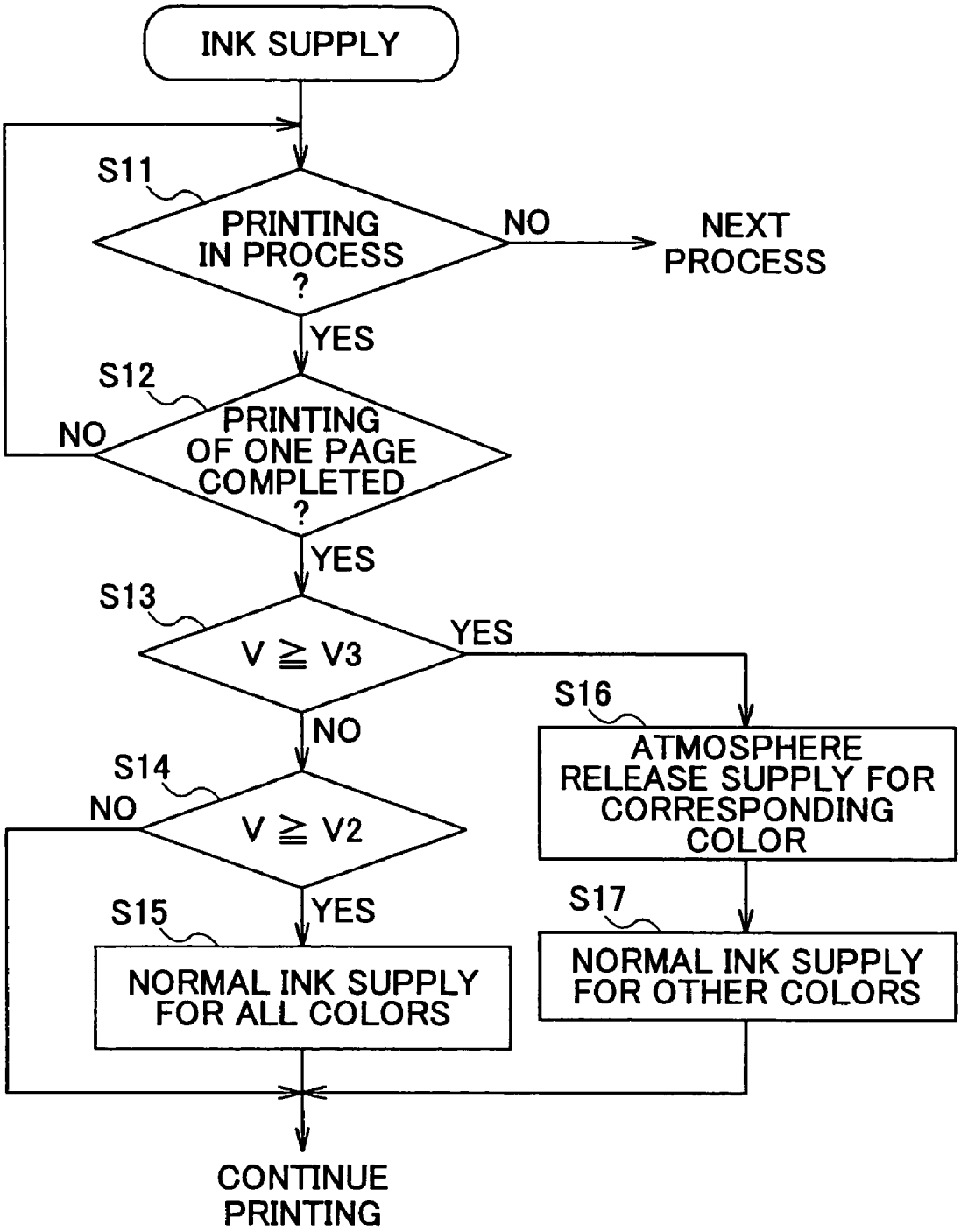
FIG. 21 is a flowchart illustrating a supply operation of supplying liquid to a sub tank according to an embodiment of the present invention.

Referring to FIG. 21, in a printing process (S11 Y), when it is determined that printing of one page has been completed (S12 Y), the amount of ink consumption V with respect to each color that is measured according to the procedures described above is read, and the read consumption amount V is compared with a predetermined third value V3 to determine whether V≧V3 (S13). It is noted in the present description, the printing of one page refers to the printing of one side of a page in the case of a dual side printing operation.

If it is determined that V≧V3 (S13 Y), the sub tank 15 of the corresponding color ink is subjected to the atmospheric release supply operation (S16). As for the sub tanks 15 of the color inks of which the ink consumption amounts V are below the predetermined value V3, normal supply operations are conducted (S17), and the printing process is continued.

When a consumption amount V is determined to be greater than or equal to V3, if a normal ink supplying operation were to be conducted, a capacity hysteresis might occur when the elastic member for generating the negative pressure in the sub tank reverts back to its original position, and the ink discharge characteristics might be destabilized due to ineffective control of the negative pressure. Thus, in such case, an atmospheric release ink supply operation is performed (S16) in order to solve the problem of hysteresis generation, and the negative pressure is reestablished after the ink is supplied so that stable ink discharge characteristics may be obtained.

If it is determined that there is no ink of which the ink consumption amount V≧V3 (S13 N), the amount V for each of the colors is compared with a predetermined second value V2 (V2<V3) to determine whether V≧V2 (S14). If there is an ink of which the consumption amount V≧V2 (S14 Y), a normal supply operation is conducted for the sub tank 15 of each of the colors (S15) after which the printing operation is continued.

Figure 22:
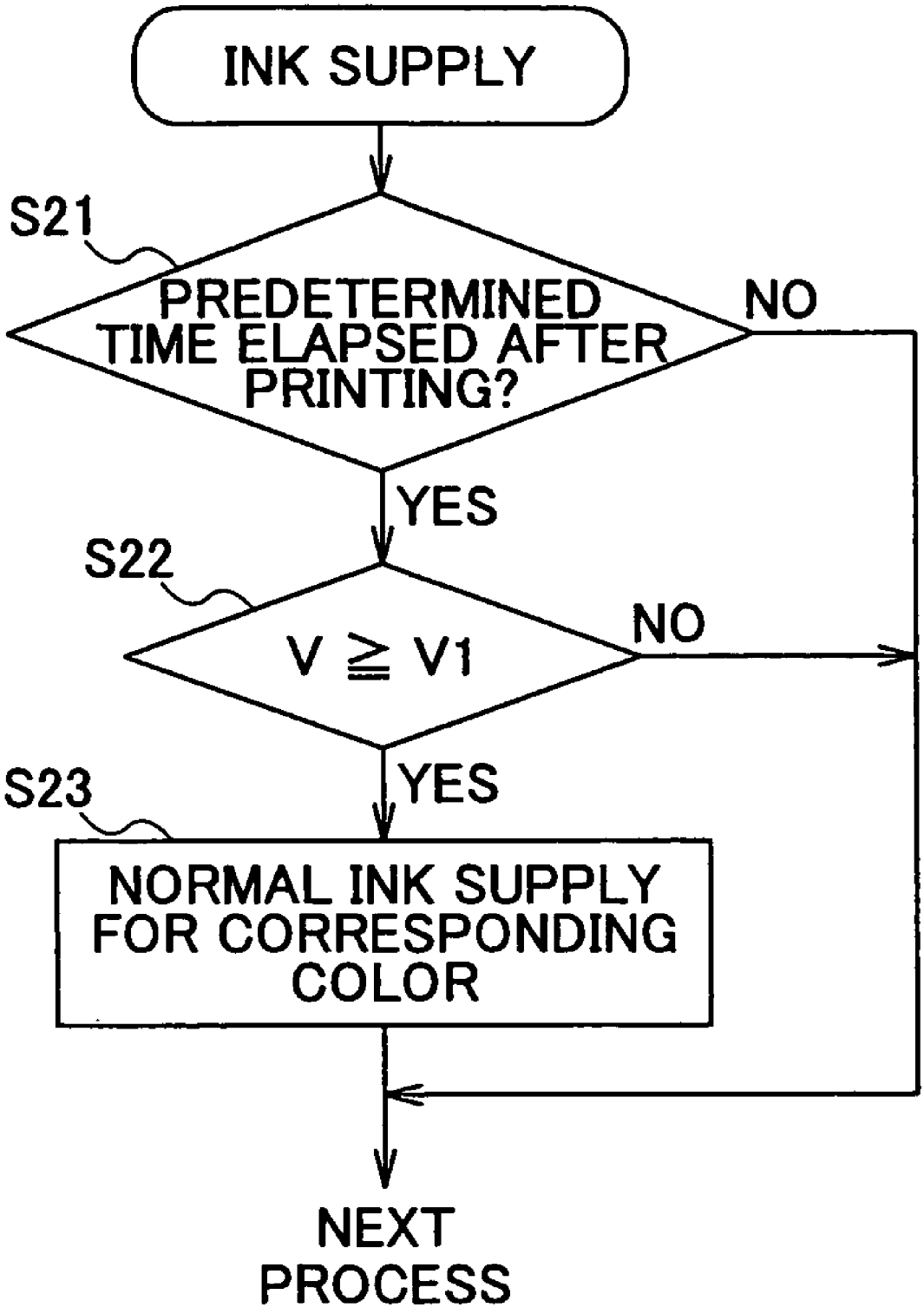
FIG. 22 is another flowchart illustrating the supply operation.

Referring to FIG. 22, when the printing process ends, and a predetermined time period elapses therefrom (S21 Y), the consumption amount V of each ink is read, and each consumption amount V is compared with a predetermined first value V1 to determine whether V≧V1 (S22).

If is determined that at least one ink satisfies the condition V≧V1 (S22 Y), the sub tank 15 of the corresponding color is subjected to a normal supply operation during a capping operation (nozzle restoration operation).

Herein, by setting the value of V1 to a relatively small value, the sub tank 15 may be filled with ink before being switched to standby mode. The ink supply operation performed herein may not hinder a printing operation since it is performed at the end of the printing operation. On the other hand, when an amount of ink within a range between V2 and V3 is consumed, a supply operation may be quickly performed at the end of printing one page before the consumption amount exceeds V3. By conducting the ink supply operation according to the amount of ink consumption using a combination of differing standard values, time and ink may be efficiently used and stable discharge characteristics may be obtained.

Specifically, a counter adapted for measuring the amount of ink consumption V (ml) may be provided, the first predetermined value V1 may be set to 0.2, the second predetermined value V2 to 0.9, and the third predetermined value V3 to 1.1, for example. Accordingly, if the condition V≧0.2 is satisfied, after a predetermined time elapses from the time a printing operation ends, a normal supply operation is conducted while the nozzle of the corresponding color is capped. If the condition 1.1>V≧0.9 is satisfied after completing the printing of one page, normal supply operations are performed with respect to all the colors, after which the printing process is continued. If the condition V≧1.1 is satisfied, the atmospheric release supply operation is performed with respect to the corresponding color and normal supply operations are performed with respect to the rest of the colors, after which the printing process is continued.

It is noted that the ink supply from the main tank 10 to the sub tank 15 may be realized by activating a pump, for example. Also, it is noted that the above ink supply operation is performed in the case where the main tank 10 is not empty. Further, once the ink supply apparatus is completed, the amount of ink consumption for the ink may be reset to zero. In the case where the main tank is empty, the ink supply operation may not be performed, and thereby, the amount of ink consumption may not be reset to zero.

Figure 23:
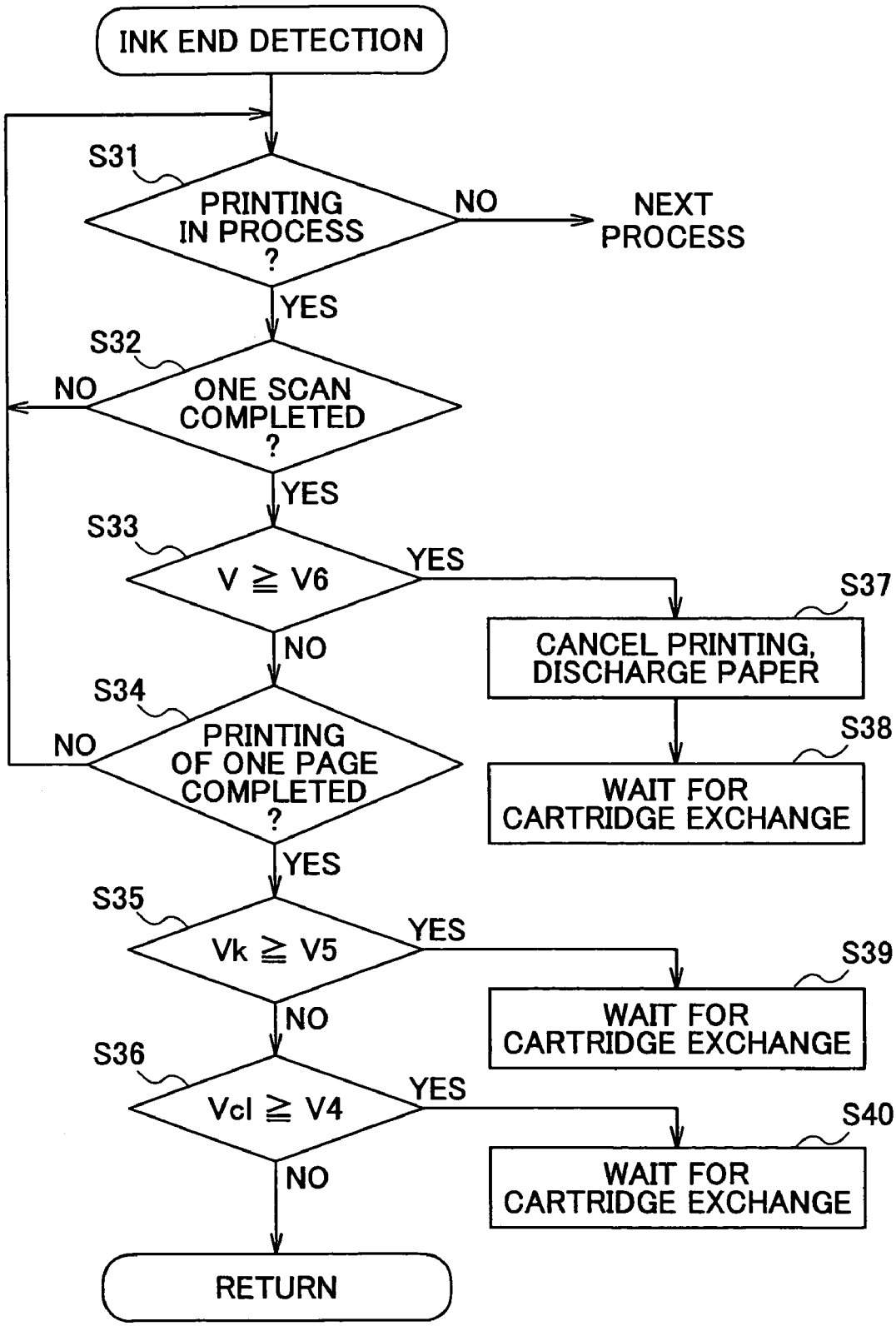
FIG. 23 is a flowchart illustrating an ink end detection operation.

In the following, an ink end detection operation according to an embodiment of the present invention is described with reference to FIG. 23.

According to this embodiment, during a print operation (S31 Y), after the completion of one scan conducted by the carriage 13 (S32 Y), the ink consumption amount V is read and compared with a predetermined sixth standard value V6 to determine whether V≧V6 (S33).

If the amount of ink consumed V for at least one of the color inks is determined to be V≧V6 (S33 Y), the printing operation is canceled and the recording medium is discharged (S37), and the recording apparatus may be switched to waiting mode for the ink cartridge 10 to be exchanged (S38). In other words, the recording apparatus may be switched to an all-ink printing disabled state during the process of printing one page.

When the printing of one page is completed (S34 Y), the amount of ink consumption for black ink Vk is compared with a predetermined fifth standard value V5 (V5<V6 ) to determined whether Vk≧V5 (S35). Herein, if it is determined that Vk≧V5 (S35 Y), the recording apparatus may be switched to waiting mode for the ink cartridge 10 of black ink to be exchanged (S39). In other words, the recording apparatus may be switched to a black ink printing disabled state after outputting one page.

If it is determined that the condition Vk≧V5 is not satisfied (S35 N), a color ink consumption amount Vcl is compared with a predetermined fourth standard value V4 (V4<V5 ) to determine whether Vcl≧V4 (S36). Alternatively, this determination step may also be performed when the recording apparatus still is waiting for the black ink cartridge to be exchanged. In either case, when it is determined that the amount of ink consumed for at least one of the color inks satisfies the condition Vcl≧V4 (S36 Y), the recording apparatus may be switched to waiting mode for the ink cartridge of the corresponding color ink to be exchanged (S40). In other words, the recording apparatus may be switched to a color ink printing disabled state after outputting one page.

Specifically, for example, a counter adapted for measuring the amount of ink consumption V (ml) may be provided, the fourth predetermined value V4 may be set to 5.0, the fifth predetermined value V5 to 5.5, and the sixth predetermined value V6 to 5.8. Accordingly, if the condition Vcl≧5.0 is satisfied after the completion of printing one page, the recording apparatus may be switched to a state of waiting for the color ink cartridge to be exchanged. If the condition Vk≧5.5 is satisfied after the completion of printing one page, the recording apparatus may be switched to a state of waiting for the black ink cartridge to be exchanged. If the condition V≧5.8 is satisfied, the printing operation may be canceled and the recording medium maybe discharged, and the recording apparatus may be switched to a state of waiting for the ink cartridge to be exchanged.

With respect to the relation between the first through third standard values and the fourth through sixth standard values, it is noted that the first through third standard values are used in a sub tank ink supply operation, while the fourth through sixth standard values are used in a main tank (ink cartridge) ink end detection operation. Accordingly, the fourth through sixth standard values may be set to have values relatively greater than the first through third standard values. Also, the relation between the fourth standard value and the fifth standard value may be set according to use. Specifically, for example, a monochrome image may be presumed to consist mainly of text content whereas a color image may be presumed to represent pictures and/or graphics. Generally, text documents require little ink whereas pictures and graphics require large amounts of ink for their reproduction. Thereby, in preventing ink from running out during the printing of one page, it may be effective to set the fourth standard value for detecting the ink end of a color ink to a smaller value than the fifth standard value for detecting the ink end of the black ink.

However, it is noted that in a case where the capacities of ink cartridges for the color inks are set equal, it may not be necessary to distinguish between the fourth standard value and the fifth standard value. Alternatively, in a case where at least one ink cartridge of a color ink other than black ink has a greater capacity than the rest of the cartridges of color inks other than black ink, a different standard value for the corresponding color ink may be set accordingly.

Figure 24:
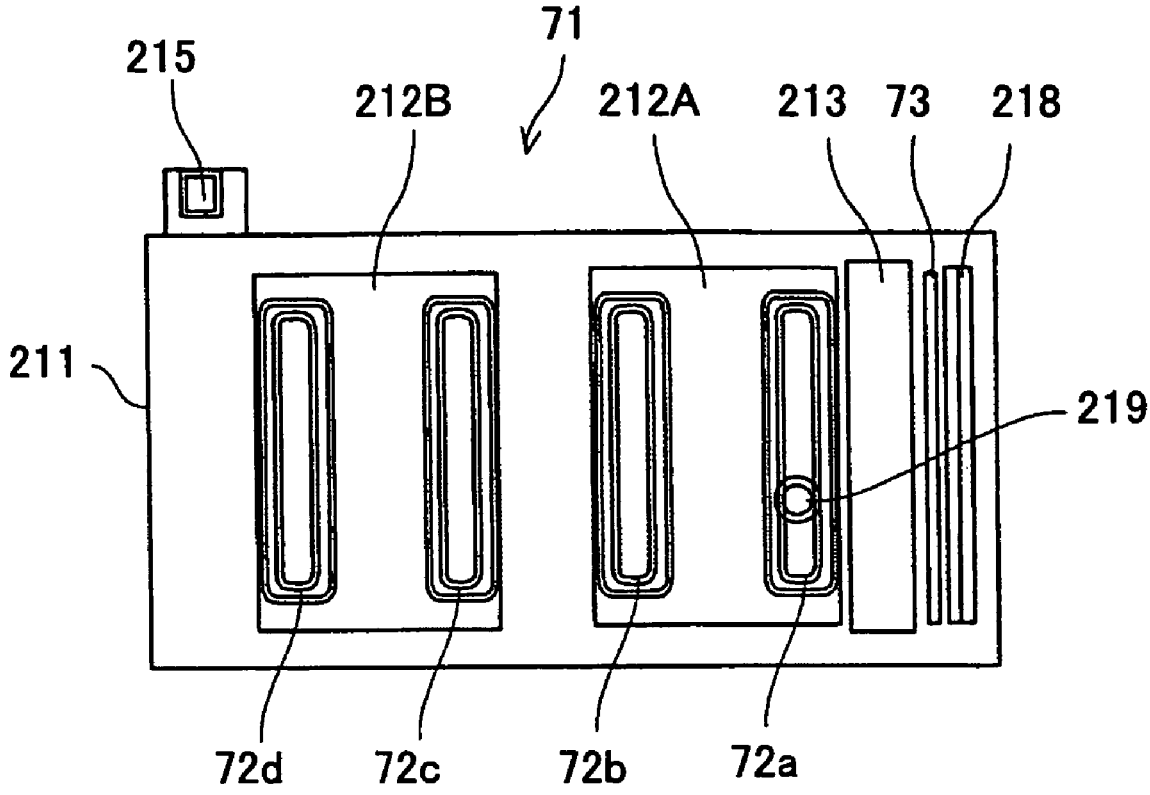
FIG. 24 is a plan view of the subsystem according to an embodiment of the present invention.
Figure 25:
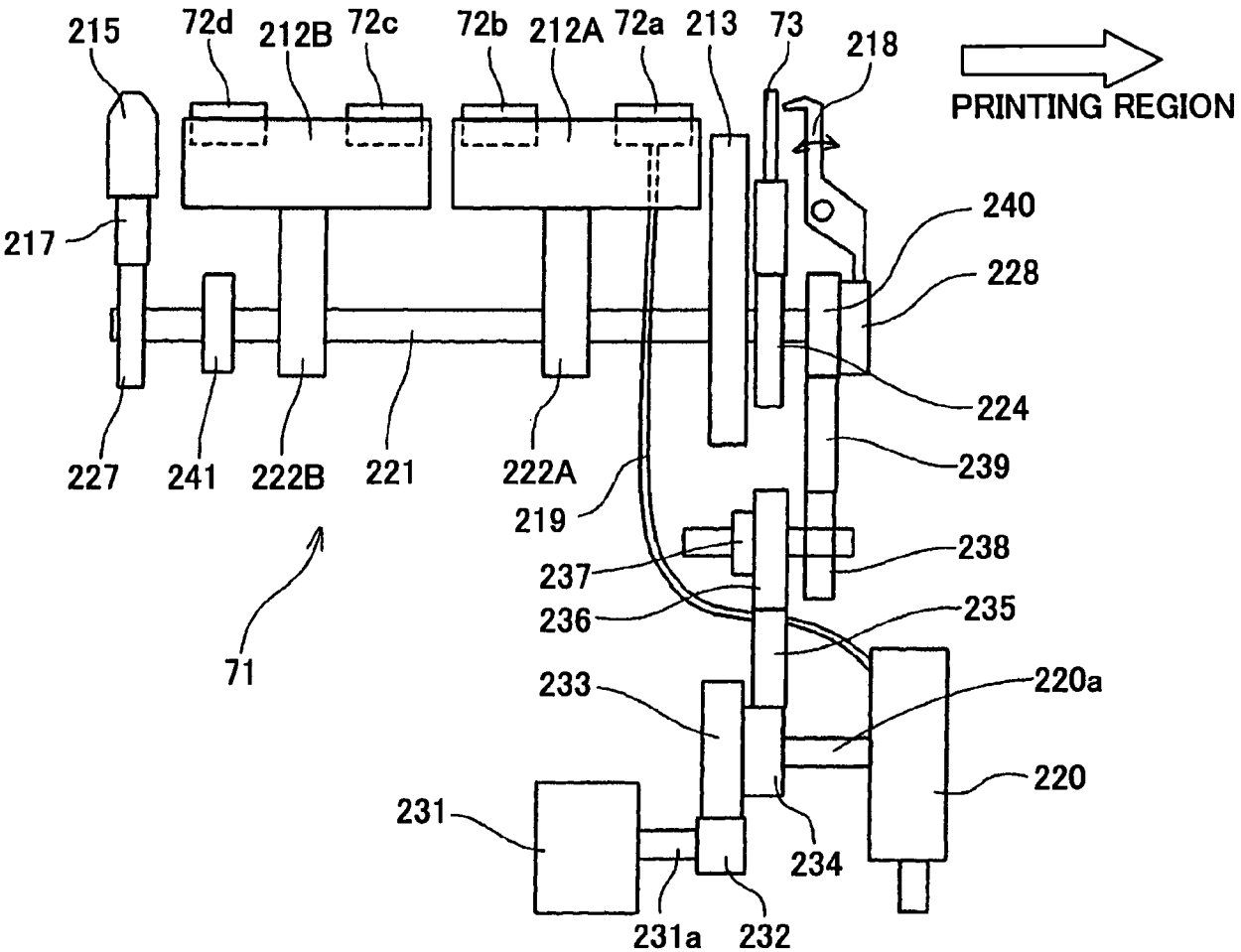
FIG. 25 is a side view of the subsystem of FIG. 24.

In the following, the subsystem 71 is described in detail with reference to FIGS. 24 and 25, where FIG. 24 shows a top view of the sub system 71, and FIG. 25 shows a schematic structure of the sub system 71 viewed from the side.

As is shown in the drawings, the subsystem 71 includes a frame 211, in which two cap holders 212A and 212B, an air shot discharge receiver 213, a wiper blade 73 corresponding to a wiping member including an elastic body as cleaning means, and a carrier lock 215 are movably held.

The cap holders 212A and 212B (collectively referred to as 'cap holder 212' hereinafter) have two caps 72*a* and 72*b*, and 72*c* and 72*d*, respectively (collectively referred to as 'cap 72' hereinafter), each for capping the nozzle surfaces of the recording heads 14.

In the present example, a tube pump (vacuum pump) 220 corresponding to absorption means is connected to the innermost cap 72*a* held by the cap holder 212A that is closest to the printing region, the connection being realized via a tube 219. The other caps 72*b*, 72*c*, 72*d* are not connected to the tube pump 220 in this example. In other words, the cap 72*a* corresponds to a restoration and moisture retention cap, whereas the other caps 72*b*, 72*c*, 72*d* correspond to mere moisture retentions caps. Accordingly, when a restoration operation is to be performed on a recording head 14, the corresponding recording head 14 is selectively moved to a capping position of the cap 72*a*.

As is shown in FIG. 25, a cam axle 221 is rotatably placed under the cap holders 212A and 212B. At the cam axle 221, cap cams 222A and 222B for raising and lowering the cap holders 212A and 212B, respectively, a wiper cam 224 for raising and lowering the wiper blade 73, and a carriage lock cam 225 for raising and lowering the carriage lock 215 via a carriage lock arm 217 are each provided.

At the printing region side of the wiper blade 73, a wiper cleaner 218 that oscillates in the directions indicated by the arrows in FIG. 25 to clean the wiper blade 73 is provided, the wiper cleaner 218 being forced in a direction away from the wiper blade 73 by means of a spring (not shown). Also, a wiper cleaner cam 228 for oscillating the wiper cleaner 218 is disposed at the cam axle 221.

The caps 72 are raised and lowered by the cap cams 222A and 222B. The wiper blade 73 is raised and lowered by the wiper cam 224, and upon being lowered, the wiper cleaner 218 closes in on the wiper blade 73 so that the wiper blade 73 is held between the wiper cleaner 218 and the air shot discharge receiver 213 and lowered. In this way, ink adhering to the wiper blade 73 may be scratched off by the wiper cleaner and contained in the air shot discharge receiver 213.

The carriage lock 215 is forced in an upper direction (locking direction) by means of a compression spring (not shown), and is raised and lowered by the carriage lock arm 217.

In order to drive and rotate the tube pump 220 and the cam axle 221, a motor gear 232 disposed at a motor axle 231*a* of a motor 231 is engaged to a pump gear 233 disposed at a pump axle 220*a* of the tube pump 220, an intermediate gear 234 attached to the pump gear 233 is engaged via an intermediate gear 235 to an intermediate gear 236 implementing a unidirectional clutch 237, and an intermediate gear 238 that shares the same axis with the intermediate gear 236 is engaged via an intermediate gear 239 to a cam gear 240 that is fixed to the cam axle 221.

The cam axle 221 implements a home position sensor cam 241 for detecting a home position, wherein at a home position sensor (not shown) implemented in the sub system 71, when a cap 72 reaches the lowermost edge, a home position lever (not shown) is operated, and the sensor is opened to detect the home position of the motor 231. It is noted that when the power is turned on, the home position sensor cam 241 moves up and down regardless of the position of the cap 72 (cap holder 212), and the position detection is not conducted until the home position sensor cam 241 is moved. After the home position of the cap 72 is detected, the home position sensor cam 241 is moved by a predetermined distance to be positioned at the lowermost edge. Then, the carriage is moved sideways and is returned to the cap position after position detection, and the recording heads 14 are capped.

In the subsystem 71, with the normal rotation of the motor 231, the motor gear 232, the intermediate gear 233, the pump gear 234, and the intermediate gears 235 and 236 are rotated, and with the rotation of the axle 220*a* of the tube pump 220, the tube pump 220 is operated to conduct the absorption of the restoration and moisture retention cap 72*a*. The rotations of the other gears following the gear 238 are blocked by the unidirectional clutch 237.

With the reverse rotation of the motor 231, the unidirectional clutch 237 is connected, and thereby, the rotation of the motor 231 causes the rotation of the motor gear 232, the intermediate gear 233, the pump gear 234, the intermediate gears 235, 236, 238, and 239 so as to be conveyed to the cam gear 240. In this way, the cam axle 221 is rotated. In this case, the tube pump 220 is arranged to be prevented from rotating when the pump axle 220*a* rotates in the reverse direction.

Accordingly, in the state where a recording head 14 subjected to a restoration operation is positioned at a capping position of cap 72*a*, a first step may be conducted by rotating the motor 231 in the reverse direction to rotate the cam 221 and raise the cap 72*a*, capping the nozzle surface of the recording head 14, rotating the motor 231 in the normal direction to operate the tube pump 220, and absorbing ink from the nozzle of the recording head 14.

The first step may be followed by a second step of rotating the motor 231 in the reverse direction to rotate the cam 221, and thereby separating the cap 72*a* from the nozzle surface of the recording head 14. The second step may be followed by a third step of raising the wiper blade 73 to a wiping position (contact position with the nozzle surface), moving the carriage 13 in this state to wipe and clean the nozzle surface of the recording head 14 with the wiper blade 73, and lowering the wiper blade 73 to separate the wiper blade 73 from the nozzle surface.

The third step may be followed by a fourth step of operating the tube pump 220, and absorbing the ink in the cap 72*a*.

In the restoration operation of the sub system 71 as described above, the ink absorbed by the absorption pump (tube pump) 220 and/or the ink adhering to the wiper blade 73 and removed from the wiper blade 73 by the wiper cleaner 218 are handled as waste ink and are discharged into a waste liquid tank (not shown).

Figure 26:
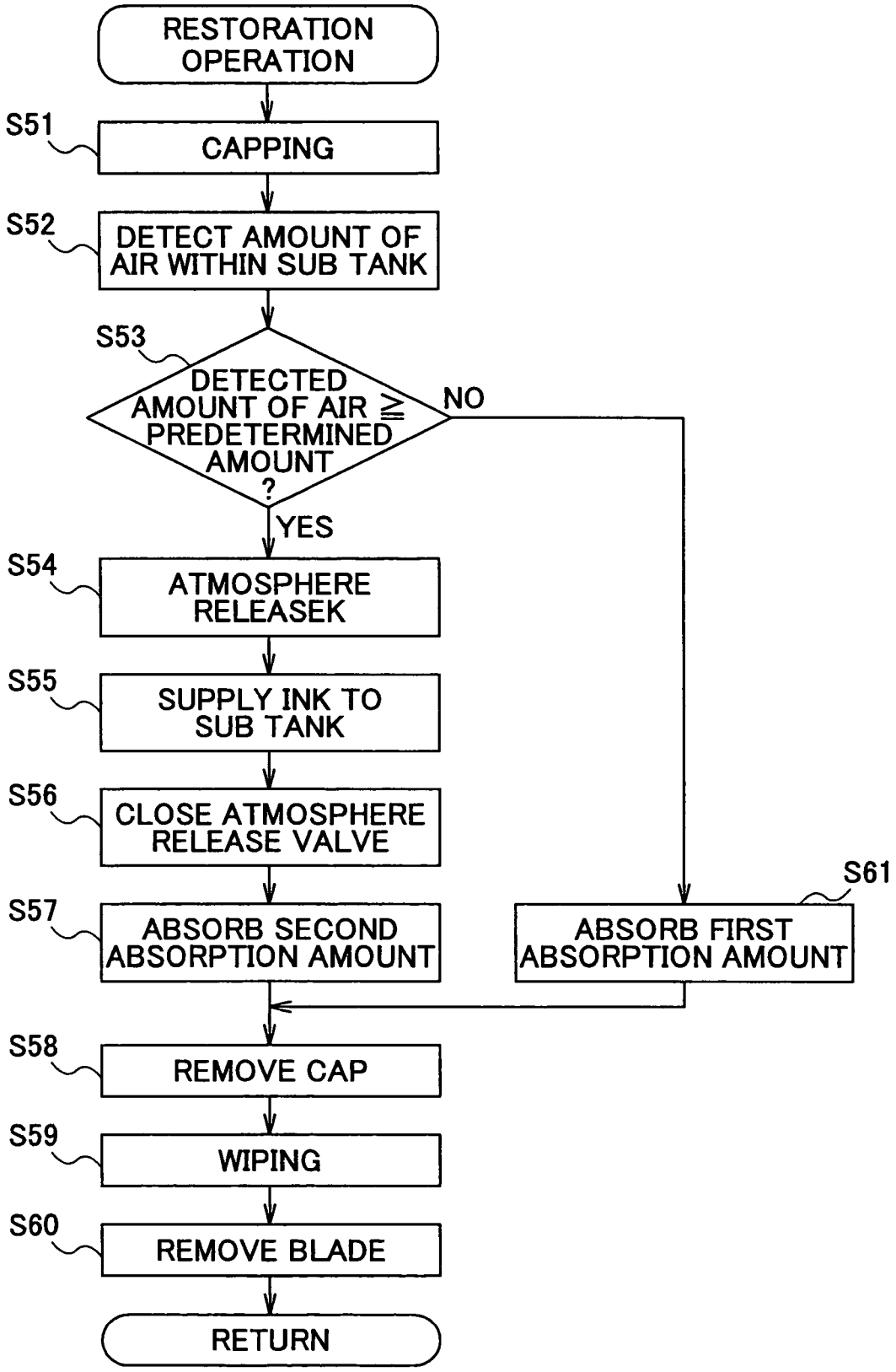
FIG. 26 is a flowchart illustrating a nozzle restoration operation according to an embodiment of the present invention.

In the following, an example of a nozzle restoration operation for restoring the state of a recording head nozzle is described with reference to FIG. 26. This nozzle restoration operation may be controlled by the control unit 280 shown in FIG. 19, for example.

As is described above, a recording head that is being subjected to the restoration operation is positioned at a capping position of the cap 72*a*, and the nozzle surface of the recording head 14 is capped by raising the cap 72*a* (S51).

Then, the detection signals from the electrodes 141 and 142 of the sub tank 15 are checked to detect the amount of gas in the sub tank 15 (S52), and a determination is made as to whether the detected amount of gas is greater than or equal to a predetermined amount (S53).

When it is determined that the amount of gas within the sub tank 15 is below the predetermined amount (S53 N), the tube pump 220 is operated so that a first absorption amount is absorbed from the nozzle of the recording head 14 (S61), and then, the cap 72*a* is moved away from the nozzle surface of the recording head 14 (S58). Then, the wiper blade 73 is raised to a wiping position (contact position with the nozzle surface), and the carriage 13 is moved in this state so that the nozzle surface may be wiped and cleaned (S59). Then, the wiper blade is lowered to be positioned away from the nozzle surface (S60). Herein, for the purpose of preventing color mixing, the recording head 14 may discharge ink from its nozzle after the wiper blade 73 is pulled away from the nozzle surface.

When it is determined that the amount of air within the sub tank 15 is above or equal to the predetermined amount (S53 Y), the drive unit 162 is driven and controlled to operate the atmospheric release valve mechanism 132 of the sub tank 15 so that the sub tank 15 may be opened to the atmosphere (S54). Then, ink is supplied to the sub tank 15 (S55). Herein, the supplying of ink may be performed until the electrodes 141 and 142 detect that the sub tank 15 has reached its full capacity, for example.

By performing atmospheric release while supplying ink into the sub tank 15, excessive air accumulated in the sub tank 15 may be discharged through the atmospheric release valve mechanism 132. Then, the drive unit 162 may be driven and controlled to close the atmospheric release valve mechanism 132 (S56), and the tube pump 220 may be operated so that a second absorption amount is absorbed from the nozzle of the recording head 14 (S57).

It is noted that the second absorption amount is greater than the first absorption amount. When the atmospheric release operation is not performed, the negative pressure within the sub tank 15 may be maintained, and thereby, cleaning effects may be obtained even with a small absorption amount. However, when the atmospheric release operation is performed, the negative pressure within the sub tank 15 cannot be maintained, and thereby, a greater absorption amount is desired in order to reestablish the negative pressure within the sub tank 15. In other words, different absorption amounts are used depending on whether the atmospheric release operation is performed in the restoration operation.

Then, as described above, the cap 72 is moved away from the nozzle surface of the recording head 14 (S58), the wiper blade 73 is raised to the wiping position (contact position with the nozzle surface), and the carriage 13 is moved so that the nozzle surface may be wiped and cleaned (S59). Then, the wiper blade is lowered so as to be positioned away from the nozzle surface (S60). It is noted that, for the purpose of preventing color mixing, for example, the nozzle of the recording head 14 may discharge ink after the wiper blade 73 is moved away from the nozzle surface.

As described above, in conducting a restoration operation, when it is determined that the amount of air within the sub tank 15 is greater than or equal to a predetermined amount, ink is supplied while opening the sub tank 15 to the atmosphere so that excessive air accumulated within the sub tank 15 may be released. In this way, air shot discharges due to bubbles formed in the ink contained within the sub tank 15 may be prevented, and the negative pressure within the sub tank 15 may be reestablished so as to stabilize the ink discharge characteristics. On the other hand, when the amount of air within the sub tank 15 is less than the predetermined amount, the sub tank 15 is not opened to the atmosphere so that the restoration operation may be performed in a shorter period of time and the amount of ink used in the restoration operation may be reduced.

Figure 27:
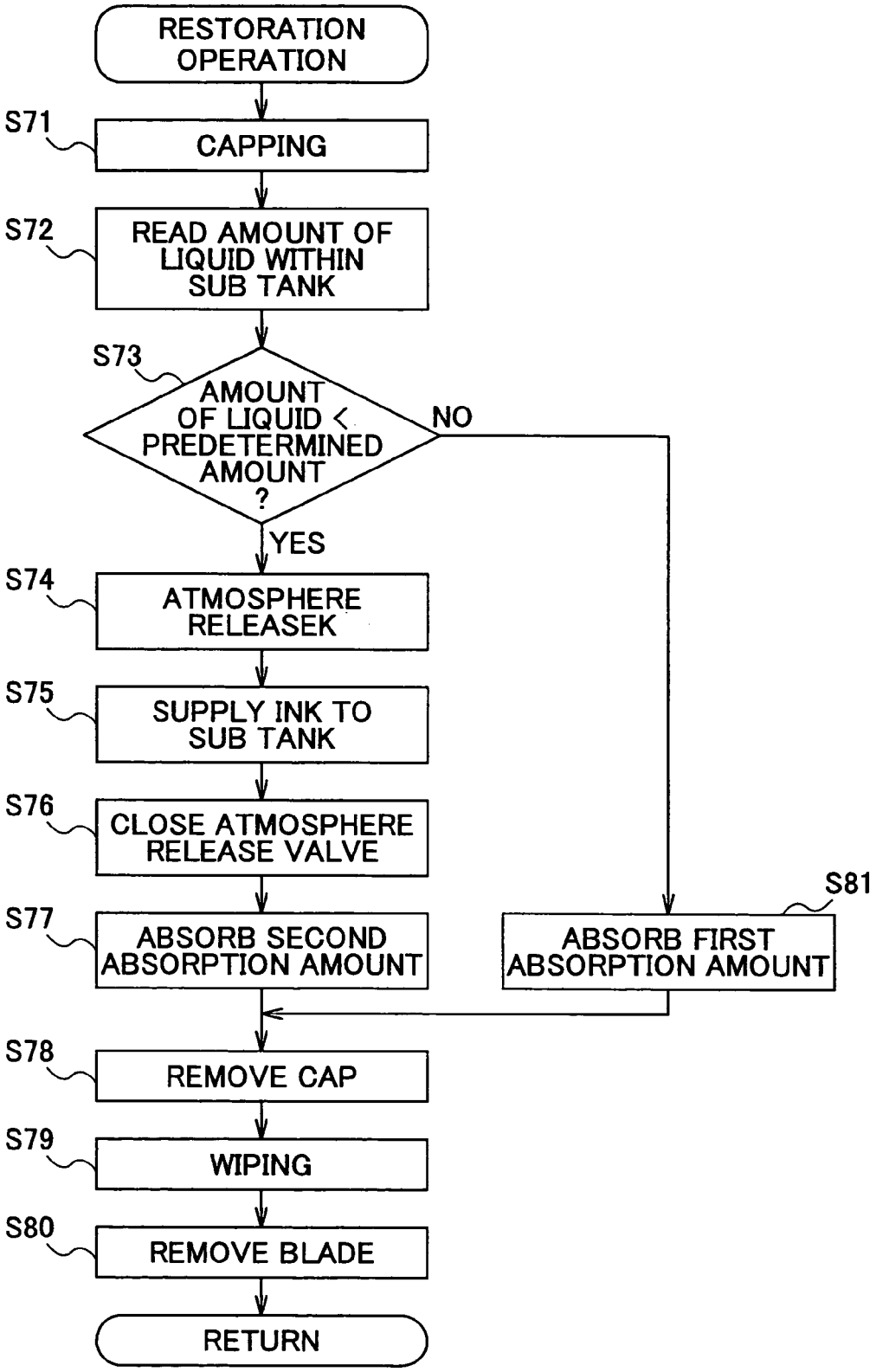
FIG. 27 is a flowchart illustrating a nozzle restoration operation according to another embodiment of the present invention.

In the following, a restoration operation of the recording apparatus according to another embodiment of the present invention is described with reference to FIG. 27.

According to this embodiment, a recording head 14 subjected to the restoration operation is positioned at a capping position of the cap 72*a*, and the cap 72*a* is raised so as to cap the nozzle surface of this recording head 14 (S71).

Then, an amount of liquid (ink) contained within the sub tank 15 that is detected (calculated) based on a liquid (ink) discharge amount and an absorption amount measured beforehand is read (S72).

In a case where information pertaining to a relation between a liquid (ink) discharge amount and an absorption amount is stored, the amount of liquid (ink) within the sub tank 15 may be calculated using formula (3) shown below.

$$\text{Liquid Amount in Sub Tank} = \text{Full Capacity of Sub Tank} - \{\Sigma(\text{discharge amount} \times \text{number of discharges}) + \Sigma(\text{absorption amount} \times \text{number of absorptions})\} \quad (3)$$

Since the sub tank corresponds to a flexible structure that includes a flexible film member and an elastic member, it is rather difficult to provide means for accurately detecting the amount of liquid in the sub tank itself. Thus, by subtracting the consumption amount, corresponding to the sum of the used amount (obtained from the liquid discharge amount and the number of discharges), and the absorbed amount (obtained from the absorption amount and the number of absorptions), from the amount of liquid at full capacity of the sub tank 15, the amount of liquid remaining in the sub tank 15 may be accurately calculated.

In a case where different discharge amounts according to different discharge patterns and the absorption amount are stored, the liquid amount within the sub tank 15 may be calculated according to formula (4) shown below.

$$\text{Liquid Amount within Sub Tank} = \text{Full Capacity of Sub Tank} - \{\Sigma(\text{specific pattern discharge amount} \times \text{number of specific pattern discharges}) + \Sigma(\text{absorption amount} \times \text{number of absorptions})\} \quad (4)$$

For example, in the case of conducting tone printing, discharge amount data corresponding to a tone pattern may be stored beforehand, and thus, the corresponding discharge amount data may be multiplied by the occurrence number of the tone so as to obtain a more accurate detection (calculation) compared to the case of simply multiplying the discharge amount and the number of discharges.

It may then be determined whether the calculated liquid amount (ink amount) of the sub tank 15 is below a predetermined amount (S73). Alternatively, in a case where the full capacity amount of the sub tank 15 is fixed, this determination may be made based on the ink consumption amount of the sub tank 15.

In the above determination, if the amount of ink in the sub tank 15 is determined to be greater than or equal to the predetermined amount (S73 N), the tube pump 220 is operated and a first absorption amount is absorbed from the nozzle of the recording head 14 (S81). Then, the cap 72*a* is moved away from the nozzle surface of the recording head 14 (S78), and the wiper blade 73 is raised to a wiping position (contact position with the nozzle surface) so that the nozzle surface may be wiped clean as the carriage 13 is moved (S79). Then, the wiper blade is lowered so as to be positioned away from the nozzle surface (S80).

On the other hand, when the ink amount within the sub tank 15 is determined to be less than the predetermined amount, the drive unit 162 is driven and controlled to operate the atmospheric release valve mechanism 132 of the sub tank 15 so that the sub tank 15 may be opened to the atmosphere (S74). Then, ink may be supplied to the sub tank 15 (S75). Herein, ink may be supplied to the sub tank 15 until the electrodes 141 and 142 detect the sub tank 15 to be fully replenished.

By supplying ink while opening up the sub tank 15 to the atmosphere, excessive air accumulated in the sub tank 15 may be discharged via the atmospheric release valve mechanism 132. Then, the drive unit 162 is driven and controlled to close the atmospheric release valve mechanism 132 of the sub tank 15 (S76), and the tube pump 220 is operated so that a second absorption amount is absorbed from the nozzle of the recording head 14 (S77).

It is noted that the second absorption amount is greater than the first absorption amount. When the atmospheric release operation is not performed, the negative pressure within the sub tank 15 may be maintained, and thereby, cleaning effects may be obtained even with a small absorption amount. However, when the atmospheric release operation is performed, the negative pressure within the sub tank 15 cannot be maintained, and thereby, a greater absorption amount is required in order to reestablish the negative pressure within the sub tank 15. In other words, different absorption amounts are used depending on whether the atmospheric release operation is performed in the restoration operation.

Then, as described above, the cap 72 is moved away from the nozzle surface of the recording head 14 (S78), the wiper blade 73 is raised to the wiping position (contact position with the nozzle surface), and the carriage 13 is moved so that the nozzle surface may be wiped and cleaned (S79). Then, the wiper blade is lowered so as to be positioned away from the nozzle surface (S80). It is noted that, for the purpose of preventing color mixing, for example, the nozzle of the recording head 14 may discharge ink after the wiper blade 73 is moved away from the nozzle surface.

Also, it is noted that in the description of the embodiments of the restoration operation, the first and second absorption amounts do not signify any specific values; rather, the first absorption amount represents the absorption amount in a case where an atmospheric release operation is not performed, and the second absorption amount represents the absorption amount in a case where an atmospheric release operation is performed.

As described above, in conducting a restoration operation, when the amount of liquid within the sub tank 15 is less than a predetermined amount, ink is supplied while opening the sub tank 15 to the atmosphere so that the capacity of the sub tank 15 may be prevented from becoming too small, and the hysteresis of capacity change caused by the contraction and return of the elastic member may be reduced. In this way, the negative pressure within the sub tank 15 may be controlled, and the ink discharge characteristics may be stabilized. On the other hand, when the amount of liquid within the sub tank 15 is greater than or equal to the predetermined amount, the sub tank 15 is not opened to the atmosphere so that the restoration operation may be performed in a shorter period of time and the amount of ink used in the restoration operation may be reduced.

It is noted that in the above description of preferred embodiments, applications of the present invention in an inkjet recording apparatus (printer) are illustrated; however, the present invention is not limited to the above embodiments and may also be applied to a facsimile apparatus, a copier apparatus, or a printer/fax/copier multi-function imaging apparatus, for example. Also, the present invention may be applied to an imaging apparatus that uses liquid other than ink, a liquid supply apparatus used in such an imaging apparatus, and a liquid container used in such a liquid supply apparatus, for example.

In the following, examples of ink as liquid used in the imaging apparatus are described. However, it is noted that the present invention is not limited to use of this particular ink.

First, the static surface tension $\gamma$ of the ink at 25° C. is preferably arranged so that $\gamma \geqq 20$. In this way, discharge stability may be secured.

When the static surface tension $\gamma$ of the ink at 25° C. is $\gamma \geqq 20$, ink drops may be regularly formed, and a clear image may be generated. On the other hand, if $20 > \gamma$, the ink may substantially wet the entire nozzle surface, or it may form a lower contact angle, and thereby, ink may leak around the nozzle. In such state, a normal meniscus may not be formed at the nozzle, and thereby, ink drops may not be regularly formed. That is, the discharge direction may be disoriented, undesired small drops (satellite drops) may be generated, a mist may be created, or in a worst case scenario, the ink drop may not be discharged, for example. In such situation, it is difficult to form a designated pixel as desired, and image defects are likely to occur.

The ink may also contain a coloring material. The coloring material may be included in the ink in a dissolved state, or the coloring material may be included in a dispersed state, for example. If the coloring material is to be included in a dissolved state, dye is preferably used. If the coloring material is to be included in a dispersed state, pigment or dye having low solubility with respect to a solvent is preferably used. By using pigment, high light resistance and water resistance may be obtained.

Accordingly, the coloring material is preferably included in the ink in a dispersed state. In such case, a pH change may occur the instant the ink drop comes into contact with the surface of a recording medium (paper), at which point the dispersed state of the coloring material may be broken down so as to cause the coloring material to condense. Also, the coloring material may be caught in the fibers of the recording medium so that the ink may not flow far from its landing spot. Owing to such effects, feathering and color bleeding may be prevented, and a clear image may be generated.

On the other hand, when the coloring material is included in the ink in a dissolved state, even when a pH change occurs the instant the ink lands on the recording medium, the dissolved coloring material may not easily precipitate and thereby, the coloring material may not be condensed. Also, when the ink penetrates into the recording medium, if the coloring material is in a dissolved state, it may not be caught in the fibers of the recording medium and may thus flow relatively far out. As a result, feathering and color bleeding are likely to occur so that a clear image may not be generated.

Among the dyes that are classified into acid dyes, direct dyes, reactive dyes, and food dyes according to a color index, dye that is provided with good water resistance and light resistance characteristics may be used as dye to be included in the present ink. Also, it is noted that a mixture of plural types of dye, or a mixture of one or more types of dyes and one or more other types of coloring material such as pigment may be used as well. These coloring materials may be added to the extent of not deterring the desired effects of the ink.

In the following, a listing of specific dyes that may be used in the present embodiment is given.

With respect to acid dyes and food dyes, the following dyes may possibly be used.

C. I. acid yellow 17, 23, 42, 44, 79, 142,

C. I. acid red 1, 8, 13, 14, 18, 26, 27, 35, 37, 42, 52, 82, 87, 89, 92, 97, 106, 111, 114, 115, 134, 186, 249, 254, 289, C. I. acid blue 9, 29, 45, 92, 249

C. I. acid black 1, 2

With respect to direct dyes, the following types of dyes may be used.

C. I. direct yellow 1, 12, 24, 26, 33, 44, 50, 86, 120, 132, 142, 144,

C. I. direct red 1, 4, 9, 13, 17, 20, 28, 31, 39, 80, 81, 83, 89, 225, 227,

C. I. direct orange 26, 29, 62, 102,

C. I. direct blue 1, 2, 6, 15, 22, 25, 71, 76, 79, 86, 87, 90, 98, 163, 165, 199, 202, C. I. direct black 19, 22, 32, 38, 51, 56, 71, 74, 75, 77, 154, 168, 171

With respect to reactive dyes, the following types of dyes may be used.

C. I. reactive black 3, 4, 7, 11, 12, 17,

C. I. reactive yellow 1, 5, 11, 13, 14, 20, 21, 22, 25, 40, 47, 51, 55, 65, 67,

C. I. reactive red 1, 14, 17, 25, 26, 32, 37, 44, 46, 55, 60, 66, 74, 79, 96,. 97, C. I. reactive blue 1, 2, 7, 14, 15, 23, 32, 35, 38, 41, 63, 80, 95

It is further noted that among these dyes, acid dyes and direct dyes are preferably used.

As for pigments, the following specific types of pigments may be used.

With respect to organic dyes, for example, azo pigments, phthalocyanine pigments, anthraquinone pigments, dioxazin pigments, indigo pigments, thioindigo pigments, perylene pigments, isoindolinone pigments, aniline black, azomethine pigments, rhodamine B lake pigments, and carbon black may be used.

With respect to inorganic dyes, for example, iron oxide, titanium oxide, calcium carbonate, barium nitrate, aluminum hydroxide, barium yellow, navy blue, cadmium red, chrome yellow, and metallic powder may be used.

Also it is noted that the above pigments are used in the form of grain particles with grain diameters that are within a arrange of 0.01~0.15 μm. When the grain diameter of the pigment is 0.01 μm or less, the opacifying power of the ink may be low, and thereby, the density of the ink may be low. Thereby, the light resistance may be lowered so that the light resistance of the ink may be the same as that of a conventional dye when being mixed with a high molecular dye. Also, when the grain diameter of the pigment particles is 0.15 μm or greater, the head and filter may be prone to clogging, and stable discharge characteristics may not be obtained.

Also, the ink preferably includes a water based organic solvent for desirably adjusting the properties of the ink, preventing the drying of ink so as to avoid discharge defects, and improving the dissolution stability and dispersion stability of the coloring materials.

For example, one of the following types of solvents or a combination thereof may be mixed with water. Specifically, the possible solvents used may correspond to multivalent alcohol such as ethylene glycol, diethylene glycol, triethylene glycol, polyethylene glycol, polypropylene glycol, 1,5-pentanediol, 1,5-hexanediol, glycerol, 1,2,6-hexanetriol, 1,2,4-buthanetriol, and petriol; multivalent alcohol alkyl ether such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; multivalent alcohol aryl ether such as ethylene glycol monophenyl ether, and ethylene glycol monobenzyl ether; nitrogen heterocyclic compounds such as N-methyl-2-pyrrolidone, N-hydroxyethyl-2-pyrrolidone, 2-pyrrolidone, 1,3-dimethyl imidazolidinone, and ε-caprolactam; amides such as formamide, N-methyl formamide, and N,N-dimethyl formamide; amines such as monoethanol amine, diethanol amine, triethanol amine, monoethyl amine, diethyl amine, and triethyl amine; sulfur compounds such as dimethyl sulfoxide, sulfolane, and thiodiethanol; propylene carbonate; carbon ethylene; or γ-butylolacton.

It is noted that among the above possible solvents, diethylene glycol, thiodiethanol, polyethylene glycol 200~600, triethylene glycol, glycerol, 1,2,6-hexantriol, 1,2,4-buthantriol, petriol, 1,5-petandiol, N-methyl-2-pyrrolidone, N-hydroxyethyl pyrrolidone, 2-pyrrolidone, and 1,3-dimethyl imidazolidinone are particularly preferable. By using these types of solvents, high solubility or dispersablility may be realized for the coloring materials, and ink discharge defects due to water evaporation may be prevented.

Also, the ink preferably includes a penetrant.

A penetrant may improve the moistness of the ink and the recording medium, and may be added in order to adjust the penetration speed of the ink. It is preferred that penetrants represented by the following chemical formulae (I)~(IV) be used in the present ink. That is, polyoxyethylene alkyl phenyl ether surfactant as represented by formula (I), acetylene glycol surfactant as represented by formula (II), polyoxyethylene alkyl ether surfactant as represented by formula (III), and polyoxyethylene polyoxypropylene alkyl ether surfactant as represented by formula (IV) are preferably used in order to reduce the surface tension of the liquid (ink), increase the moistness of the liquid (ink), and accelerate the penetration speed of the liquid (ink).

(I)

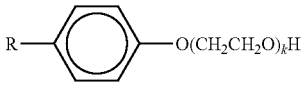

(R corresponds to a hydrocarbon chain that may be branched with a carbon number of 6~14; k: 5~20)

(II)

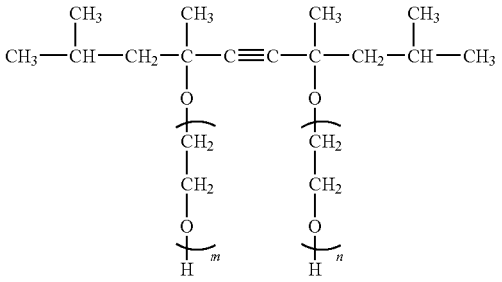

(m, n≦20, 0<m+n≦40)

$$R—(OCH_2CH_2)nOH \quad (III)$$

(R corresponds to a hydrocarbon chain that may be branched with a carbon number of 6~14; n: 5~20)

(IV)

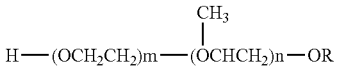

(R corresponds to a hydrocarbon chain that may be branched with a carbon number of 6~14; m, n: 20 or below)

Aside from the compounds represented by formulae (I)~(IV), other compounds such as multivalent alcohol alkyl or aryl ether such as diethylene glycol monophenyl ether, ethylene glycol monophenyl ether, ethylene glycol mono aryl ether, diethylene glycol monophenyl ether, diethylene glycol monobutyl ether, propylene glycol monobutyl ether, and tetraethylene glycol chlorophenyl ether; nonion surfactant such as polyoxyethylene polyoxpropylene block copolymer; and low grade alcohol such as fluorine surfactant, ethanol, and 2-propnol may also be used, and among these, diethylene glycol monobutyl ether is preferred.

Also, the ink preferably includes a pH adjuster agent or an antirust agent in order to prevent the dissolution and corrosion of portions that come into contact with the ink. The pH adjuster agent may correspond to any substance that is capable of adjusting the pH of the ink to above 6 without affecting the properties of the ink solution. For example, amines such as diethanol amine, and triethanol amine; hydroxide compounds of alkaline metal elements such as lithium hydroxide, sodium hydroxide, potassium hydroxide, ammonium hydroxide, quaternary ammonium hydroxide, and quaternary phoshonium hydroxide; and carbonates of alkaline metal such as lithium carbonate, sodium carbonate, and potassium carbonate may be used. As the antirust agent, for example, acid nitrite, sodium thionitrate, thiodiglycolic acid ammonite, diisopropyl ammonium nitrite, pentaerythritol tetranitrate, and dicyclohexyl ammonium nitrite may be used.

The ink may further include an antiseptic antifungal agent in order to prevent decay and molding. As the antiseptic antifungal agent, for example, sodium dehydroacetate, sodium sorbate, 2-pyridinethiol-1-sodium oxide, isothiazoline compounds, sodium benzoate, or pentachlorophenom sodium may be used.

The ink may further include an antifoaming agent in order to prevent foaming of the ink. As the antifoaming agent, a silicon antifoaming agent is preferably used. Generally, silicon antifoaming agents may be classified into oil type, compound type, self emulsifying type, and emulsion type, for example. When using a silicon antifoaming agent with a water based substance, the self-emulsifying type and the emulsion type antifoaming agents are preferred since they may provide good reliability. Also, modified silicon antifoaming agents such as obtained from amino modification, carbinol modification, methacrylic modification, polyether modification, alkyl modification, high grade fatty acid ester modification, or alkylene oxide modification may be used.

Some examples of antifoaming agents available on the market are silicon antifoaming agents by Sin-Etsu Chemicals Co., Ltd. (e.g., KS508, KS531, KM72, KM85 (product names)), silicon antifoaming agents by Dow Corning Toray Silicon Co., Ltd. (e.g., Q2-3183A, SH5510 (product names)), silicon antifoaming agents by Nippon Unicar Co., Ltd. (e.g., SAG30 (product name)), and antifoaming agents by Asahi Denka Co., Ltd. (e.g., adeka nol series (product name)).

Also, the viscosity of the ink at 20° C. is preferably above 4 mPa/sec. By maintaining the viscosity of the ink to conform to this condition, ink may be prevented from bouncing back and generating a mist, and discharge stability may be secured. Accordingly, a clear image may be obtained from the use of high viscosity ink.

However, it is noted that as the ink viscosity becomes higher, discharging air bubbles (foam) generated in the ink tends to get more difficult. Thus, in the case of using a sub tank system (an ink supplying system using the sub tank), it is preferred that such problem be properly addressed. According to embodiments of the present invention, an atmospheric release operation is performed depending on the amount of air and the amount of liquid (ink) in the sub tank so that problems caused by foaming may be prevented.

It is noted that although in the above description of embodiments of the present invention, the atmospheric release operation is separately described for the case of using the amount of air and the case of using the amount of liquid in the sub tank, other arrangements are also possible in which the atmospheric release operation is performed in either one of a case in which the amount of air in the sub tank reaches a predetermined amount or greater, or a case in which the amount of liquid in the sub tank is below a predetermined amount, and the atmospheric release operation is not performed at other times.

The invention claimed is:

1. A liquid container that accommodates liquid used in an imaging apparatus, the liquid container comprising:

a container main body that forms a liquid accommodating portion for accommodating the liquid;

a flexible film member that is attached to the container main body and is configured to seal an opening of the liquid accommodating portion; and an air flow path that is formed at the container main body and is configured to discharge air from the liquid accommodating portion; wherein the air flow path includes a plurality of trenches formed at the container main body, and a through hole that is formed at a first wall separating the trenches, wherein each of the trenches has a second wall formed by the flexible member.

2. The liquid container as claimed in claim 1, wherein the air flow path includes a trench formed at the container main body, and the through hole that is formed at the first wall blocking a portion of the trench.

3. The liquid container as claimed in claim 2, wherein the through hole is formed at a position that is detached from a flow path edge line formed by the trench and the film member.

4. The liquid container as claimed in claim 2 or 3, wherein a length of the through hole is arranged such that the liquid does not pass through the through hole when the liquid container is in use and vibration occurs.

5. The liquid container as claimed in claim 2 or 3, wherein a diameter of the through hole is arranged such that the liquid does not pass through the through hole when the liquid container is in use and vibration occurs.

6. The liquid container as claimed in claim 1, wherein the air flow path includes an accumulation portion that accumulates liquid entering the air flow path.

7. The liquid container as claimed in claim 1, further comprising:

a liquid introduction path for introducing liquid into the liquid container in a downward direction, wherein said liquid introduction path is separate from the air flow path.

8. A liquid supply apparatus that supplies liquid to a recording head of an imaging apparatus, the liquid supply apparatus comprising:

a liquid container including a container main body that forms a liquid accommodating portion for accommodating the liquid, a flexible film member that is attached to the container main body and is configured to seal an opening of the liquid accommodating portion, and an air flow path that is formed at the container main body and is configured to discharge air from the liquid accommodating portion; and a liquid supply unit for supplying liquid to the liquid container; wherein the air flow path includes a plurality of trenches formed at the container main body, and a through hole that is formed at a first wall separating the trenches, wherein each of the trenches has a second wall formed by the flexible member.

9. The liquid supply apparatus as claimed in claim 8, further comprising an atmospheric release unit for opening the air flow path of the liquid container to the atmosphere.

10. The liquid supply apparatus as claimed in claim 8, further comprising:

a liquid introduction path for introducing liquid into the liquid container in a downward direction, wherein said liquid introduction path is separate from the air flow path.

11. An imaging apparatus that forms an image by discharging liquid drops from a recording head, the imaging apparatus comprising:

a liquid supply apparatus that includes a liquid container having a container main body that forms a liquid accommodating portion for accommodating the liquid, a flexible film member that is attached to the container main body and is configured to seal an opening of the liquid accommodating portion, and an air flow path that is formed at the container main body and is configured to discharge air from the liquid accommodating portion; and a liquid supply unit for supplying liquid to the liquid container, wherein the air flow path includes a plurality of trenches formed at the container main body, and a through hole that is formed at a first wall separating the trenches, wherein each of the trenches has a second wall formed by the flexible member.

12. The imaging apparatus as claimed in claim 11, wherein the liquid container of the liquid supply apparatus is installed in a carriage that implements the recording head.

13. The imaging apparatus as claimed in claim 11, further comprising:

a liquid introduction path for introducing liquid into the liquid container in a downward direction, wherein said liquid introduction path is separate from the air flow path. of the liquid supply apparatus is installed in a carriage that implements the recording head.

14. A liquid container that accommodates liquid used in an imaging apparatus, the liquid container comprising:

a container main body that forms a liquid accommodating portion for accommodating the liquid;

a flexible film member that is attached to the container main body and is configured to seal an opening of the liquid accommodating portion; and an air flow path that is formed at the container main body and is configured to discharge air from the liquid accommodating portion; wherein the air flow path includes a plurality of trenches formed at the container main body, and a through hole that is formed at a first wall separating the trenches, wherein the air flow path includes a plurality of flow path portions, each portion having a second wall formed by the flexible film member, and wherein said flow path portions are coupled by another flow path portion, and said another flow path portion does not have a third wall formed by the flexible film member.

15. A liquid supply apparatus that supplies liquid to a recording head of an imaging apparatus, the liquid supply apparatus comprising:

a liquid container including a container main body that forms a liquid accommodating portion for accommodating the liquid, a flexible film member that is attached to the container main body and is configured to seal an opening of the liquid accommodating portion, and an air flow path that is formed at the container main body and is configured to discharge air from the liquid accommodating portion; and a liquid supply unit for supplying liquid to the liquid container; wherein the air flow path includes a plurality of trenches formed at the container main body, and a through hole that is formed at a first wall separating the trenches, wherein the air flow path includes a plurality of flow path portions, each portion having a second wall formed by the flexible film member, and wherein said flow path portions are coupled by another flow path portion, and said another flow path portion does not have a the third wall formed by the flexible film member.

16. An imaging apparatus that forms an image by discharging liquid drops from a recording head, the imaging apparatus comprising:

a liquid supply apparatus that includes a liquid container having a container main body that forms a liquid accommodating portion for accommodating the liquid, a flexible film member that is attached to the container main body and is configured to seal an opening of the liquid accommodating portion, and an air flow path that is formed at the container main body and is configured to discharge air from the liquid accommodating portion; and a liquid supply unit for supplying liquid to the liquid container, wherein the air flow path includes a plurality of trenches formed at the container main body, and a through hole that is formed at a first wall separating the trenches, wherein the air flow path includes a plurality of flow path portions, each portion having a second wall formed by the flexible film member, and wherein said flow path portions are coupled by another flow path portion, and said another flow path portion does not have a the third wall formed by the flexible film member.

* * * * *